US007054751B2

(12) United States Patent
Craig

(10) Patent No.: US 7,054,751 B2
(45) Date of Patent: May 30, 2006

(54) METHODS AND APPARATUS FOR ESTIMATING PHYSICAL PARAMETERS OF RESERVOIRS USING PRESSURE TRANSIENT FRACTURE INJECTION/FALLOFF TEST ANALYSIS

(75) Inventor: David P. Craig, Thornton, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 51 days.

(21) Appl. No.: 10/812,210

(22) Filed: Mar. 29, 2004

(65) Prior Publication Data

US 2005/0216198 A1 Sep. 29, 2005

(51) Int. Cl.
*G01V 9/00* (2006.01)
*E21B 49/08* (2006.01)

(52) U.S. Cl. ..... 702/13

(58) Field of Classification Search ..... 702/12, 702/13; 703/10; 73/152.05, 152.06, 152.18, 73/152.39, 152.41, 152.22; 166/250.07, 166/250.08

See application file for complete search history.

(56) References Cited

OTHER PUBLICATIONS

Mayerhofer, M.J. and Economides, M.J.: "Permeability Estimation From Fracture Calibration Treatments," Paper SPE 26039, Presented at the 1993 Western Regional Meeting, Anchorage, AK, May 26-28, 1993.

Mayerhofer, M.J., Ehlig-Economidies, C.A. and Economides, M.J.: "Pressure-Transient Analysis of Fracture-Calibration Tests," JPT, 229, Mar. 1995.

Ehlig-Economides, C.A., Fan, Y., and Economides, M.J.: "Interpretation Model for Fracture Calibration Tests in Naturally Fractured Reservoirs," Paper SPE 28690 Presented at the 1994 SPE International Petroleum Conference and Exhibition of Mexico, Veracruz, Mexico, Oct. 10-13, 1994.

Gringarten, A.C., Ramey, H.J., Jr., Raghavan, R.: "Unsteady-State Pressure Distributions Created by a Well With a Single Infinite-Conductivity Vertical Fracture," SPEJ, 347, Aug., 1974.

Cinco-Ley, H. and Samaniego-V., F.: "Transient Pressure Analysis: Finite Conductivity Fracture Case Versus Damage Fracture Case," Paper SPE 10179, Presented at the 1981 SPE Annual Technical Conference and Exhibition, San Antonio, TX, Oct. 5-7, 1981.

Nolte, K.G.: "A General Analysis of Fracturing Pressure Decline with Application to Three Models," SPEFE, 571, Dec., 1986.

(Continued)

*Primary Examiner*—Donald McElheny, Jr.
(74) *Attorney, Agent, or Firm*—Robert A. Kent; Baker Botts

(57) ABSTRACT

A before-closure pressure-transient leakoff analysis for a fracture-injection/falloff test is used to mitigate the detrimental effects of pressure-dependent fluid properties on the evaluation of physical parameters of a reservoir. A fracture-injection/falloff test consists of an injection of liquid, gas, or a combination (foam, emulsion, etc.) containing desirable additives for compatibility with the formation at an injection pressure exceeding the formation fracture pressure followed by a shut-in period. The pressure falloff during the shut-in period is measured and analyzed to determine permeability and fracture-face resistance by preparing a specialized Cartesian graph from the shut-in data using adjusted pseudodata such as adjusted pseudopressure data and time as variables in a first method, and adjusted pseudopressure and adjusted pseudotime data as variables in a second method.

86 Claims, 9 Drawing Sheets

| | Defined terms (212) | Basic equation with Pressure and Time variables (212) | Basic equation with Adjusted Pseudopressure and Time variables (213) | Adjusted Pseudopressure and Adjusted Pseudotime variables (214) |
|---|---|---|---|---|
| 204 | $d_j, (d_a)_j, \text{or} (d_{ap})_j$ | $d_j = \frac{p_{j-1} - p_j}{t_j - t_{j-1}}$ | $(d_a)_j = \frac{(\mu_g)_j}{\bar{\mu}_g}\left[\frac{[p_a(p)]_{j-1} - [p_a(p)]_j}{t_j - t_{j-1}}\right]$ | $(d_{ap})_j = \frac{\bar{c}_t}{(c_t)_j}\left[\frac{[p_a(p)]_{j-1} - [p_a(p)]_j}{(t_a)_j - (t_a)_{j-1}}\right]$ |
| 205 | $c_1$ or $c_{a1}$ or $c_{ap1}$ | $c_1 = \sqrt{\frac{\mu}{\phi c_t}}$ | $c_{a1} = \sqrt{\frac{\bar{\mu}_g}{\phi \bar{c}_t}}$ | $c_{a1} = \sqrt{\frac{\bar{\mu}_g}{\phi \bar{c}_t}}$ |
| 206 | $c_2$ or $c_{a2}$ or $c_{ap2}$ | $c_2 = \frac{5.615}{24} S_f w_L \sqrt{\frac{\mu}{\phi c_t}}$ | $c_{a2} = \frac{5.615}{24} S_f w_L \frac{\bar{B}_g}{(B_g)_{ne}} \sqrt{\frac{\bar{\mu}_g}{\phi \bar{c}_t}}$ | $c_{a2} = \frac{5.615}{24} S_f w_L \frac{\bar{B}_g}{(B_g)_{ne}} \sqrt{\frac{\bar{\mu}_g}{\phi \bar{c}_t}}$ |
| 207 | $b_M$ | $b_M = \frac{141.2\pi(24)}{5.615} \frac{R_0}{r_p S_f} \frac{1}{t_{ne}}$ | $b_M = \frac{141.2\pi(24)}{5.615} \frac{R_0}{r_p S_f} \frac{1}{t_{ne}}$ | $b_M = \frac{141.2\pi(24)}{5.615} \frac{R_0}{r_p S_f} \frac{1}{t_{ne}}$ |
| 208 | $m_M$ or $m_{aM} = m_M$<br>$m_{aM}$ for dual porosity | $m_M = \frac{(141.2)(2)(0.02878)(24)}{5.615} \frac{1}{r_p S_f \sqrt{k}}$<br>$m_{aM} = \frac{(141.2)(2)(0.02878)(24)}{5.615} \frac{1}{r_p S_f \sqrt{\alpha k}}$ | $m_M = \frac{(141.2)(2)(0.02878)(24)}{5.615} \frac{1}{r_p S_f \sqrt{k}}$<br>$m_{aM} = \frac{(141.2)(2)(0.02878)(24)}{5.615} \frac{1}{r_p S_f \sqrt{\alpha k}}$ | $m_M = \frac{(141.2)(2)(0.02878)(24)}{5.615} \frac{1}{r_p S_f \sqrt{k}}$<br>$m_{aM} = \frac{(141.2)(2)(0.02878)(24)}{5.615} \frac{1}{r_p S_f \sqrt{\alpha k}}$ |

Table 2B (cont'd)—Equations for before-closure pressure-transient fracture-injection/falloff analysis.

200

OTHER PUBLICATIONS

Valkó, P. and Economides, M.J.: "Fluid-Leakoff Delineation in High-Permeability Fracturing," SPEPF, 117, May, 1999.
Cinco-Ley, H. and Meng, H.-Z.: "Pressure Transient Analysis of Wells With Finite Conductivity Vertical Fractures in Dual Porosity Reservoirs," Paper SPE 18172 Presented at the 1988 SPE Annual Technical Conference and Exhibition, Houston, TX, Oct. 2-5, 1988.
Warren, J.E. and Root, P.J.: "The Behavior of Naturally Fractured Reservoirs," SPEJ, 245, Sep., 1963.
Al-Hussainy, R., Ramey, H.J., Jr., Crawford, P.B.: "The Flow of Real Gases Through Porous Media," JPT, 624, May, 1966.
Agarwal, R.G.: "Real Gas Pseudo-Time—A New Function for Pressure Buildup Analysis of MHF Gas Wells," Paper SPE 8279 Presented at the 1979 SPE Annual Fall Technical Conference and Exhibition, Las Vegas, NV, Sep. 23-26, 1979.
Meunier, D.F., Kabir, C.S., and Wittman, M.J.: "Gas Well Test Analysis: Use of Normalized Pseudovariables," PEFE, 629, Dec., 1987.
Aziz, K., Mattar, L., Ko, S., and Brar, G.S.: "Use of Pressure, Pressure-Squared or Pseudo-Pressure in the Analysis of Transient Pressure Drawdown Data From Gas Wells," J. Cdn. Petr. Tech., 58, Apr.-Jun., 1976.
Valkó, P. and Economides , M.J.: "Linear Elasticity, Fracture Shapes, and Induced Stresses," Hydraulic Fracture Mechanics, John Wiley & Sons, New York City, Chap. 2, 19-51, 1997.
Craig, David P et al., "Adapting High Permeability Leakoff Analysis to Low Permeability Sands For Estimating Reservoir Engineering Parameter" SPE 60291, dated 2000.
Ramurthy, Muthukumarappan et al, "Diagnostic Fracture Injection Test in Coals to Determine Pore Pressure and Permeability" SPE 75701, dated 2002.
Foreign communication from a related counterpart application dated May 4, 2005.

| Radial | Perkins-Kern-Nordgren | Geertsma-deKlerk |
|---|---|---|
| $(S_f)_{RAD} = \frac{3\pi E'}{16 r_f}$ | $(S_f)_{PKN} = \frac{2E'}{\pi h_f}$ | $(S_f)_{GDK} = \frac{E'}{\pi L_f}$ |

Table 1—Fracture stiffness for 2D fracture models.

FIGURE 1

| | 211 | 212 | 213 | 214 |
|---|---|---|---|---|
| 201 | Defined terms | Basic linear Equation using Pressure and Time as variables: $y_n = b_M + m_M x_n$ | Basic linear Equation using Adjusted Pseudopressure and Time as variables: $(y_a)_n = b_M + m_M (x_a)_n$ | Basic linear Equation using Adjusted Pseudopressure and Adjusted Pseudotime as variables: $(y_{ap})_n = b_M + m_M (x_{ap})_n$ |
| 202 | $y_n$, $(y_a)_n$, or $(y_{ap})_n$ | $y_n \equiv \dfrac{p_n - p_r}{d_n \sqrt{t_n}\sqrt{t_{ne}}}$ | $(y_a)_n \equiv \dfrac{(p_a)_n - p_{ar}}{(d_a)_n \sqrt{t_n}\sqrt{t_{ne}}}$ | $(y_{ap})_n \equiv \dfrac{(p_a)_n - p_{ar}}{(d_{ap})_n \sqrt{t_n}\sqrt{t_{ne}}}$ |
| 203 | $x_n$, $(x_a)_n$, or $(x_{ap})_n$ | $x_n \equiv \left[ c_1 \left[ \dfrac{d_{ne+2}}{d_n}\left(\dfrac{t_n - t_{ne+1}}{t_n t_{ne}}\right)^{1/2} + \sum_{j=ne+3}^{n} \dfrac{[d_j - d_{j-1}]}{d_n}\left(\dfrac{t_n - t_{j-1}}{t_n t_{ne}}\right)^{1/2} \right] + \dfrac{c_2}{d_n t_{ne}^{3/2}}\left[1 - \left(1 - \dfrac{t_{ne+1}}{t_n}\right)^{1/2}\right] \right]$ | $(x_a)_n \equiv \left[ c_{a1} \left[ \dfrac{(d_a)_{ne+2}}{(d_a)_n}\left(\dfrac{t_n - t_{ne+1}}{t_n t_{ne}}\right)^{1/2} + \sum_{j=ne+3}^{n} \dfrac{[(d_a)_j - (d_a)_{j-1}]}{(d_a)_n}\left(\dfrac{t_n - t_{j-1}}{t_n t_{ne}}\right)^{1/2} \right] + \dfrac{c_{a2}}{(d_a)_n t_{ne}^{3/2}}\left[1 - \left(1 - \dfrac{t_{ne+1}}{t_n}\right)^{1/2}\right] \right]$ | $(x_{ap})_n \equiv \left[ c_{ap1} \left[ \dfrac{(d_{ap})_{ne+2}}{(d_{ap})_n}\left[\dfrac{(t_a)_n - (t_a)_{ne+1}}{t_n t_{ne}}\right]^{1/2} + \sum_{j=ne+3}^{n} \dfrac{[(d_{ap})_j - (d_{ap})_{j-1}]}{(d_{ap})_n}\left(\dfrac{(t_a)_n - (t_a)_{j-1}}{t_n t_{ne}}\right)^{1/2} \right] + \dfrac{c_{ap2}(t_a)_n^{1/2}}{(d_{ap})_n t_n^{1/2} t_{ne}^{3/2}}\left[1 - \left(1 - \dfrac{(t_a)_{ne+1}}{(t_a)_n}\right)^{1/2}\right] \right]$ |

Table 2A—Equations for before-closure pressure-transient fracture-injection/falloff analysis.

200

FIGURE 2

| | Defined terms | Basic equation with Pressure and Time variables (212) | Basic equation with Adjusted Pseudopressure and Time variables (213) | Adjusted Pseudopressure and Adjusted Pseudotime variables (214) |
|---|---|---|---|---|
| 204 | $d_j, (d_a)_j$, or $(d_{ap})_j$ | $d_j \equiv \frac{p_{j-1} - p_j}{t_j - t_{j-1}}$ | $(d_a)_j \equiv \frac{(\mu_g)_j}{\bar{\mu}_g}\left[\frac{[p_a(p)]_{j-1} - [p_a(p)]_j}{t_j - t_{j-1}}\right]$ | $(d_{ap})_j \equiv \frac{\bar{c}_t}{(c_t)_j}\left[\frac{[p_a(p)]_{j-1} - [p_a(p)]_j}{(t_a)_j - (t_a)_{j-1}}\right]$ |
| 205 | $c_1$ or $c_{a1}$ or $c_{ap1}$ | $c_1 \equiv \sqrt{\frac{\mu}{\phi c_t}}$ | $c_{a1} \equiv \sqrt{\frac{\bar{\mu}_g}{\phi \bar{c}_t}}$ | $c_{a1} \equiv \sqrt{\frac{\bar{\mu}_g}{\phi \bar{c}_t}}$ |
| 206 | $c_2$ or $c_{a2}$ or $c_{ap2}$ | $c_2 \equiv \frac{5.615}{24} S_f w_L \sqrt{\frac{\mu}{\phi c_t}}$ | $c_{a2} \equiv \frac{5.615}{24} S_f w_L \frac{\bar{B}_g}{(B_g)_{ne}} \sqrt{\frac{\bar{\mu}_g}{\phi \bar{c}_t}}$ | $c_{a2} \equiv \frac{5.615}{24} S_f w_L \frac{\bar{B}_g}{(B_g)_{ne}} \sqrt{\frac{\bar{\mu}_g}{\phi \bar{c}_t}}$ |
| 207 | $b_M$ | $b_M \equiv \frac{141.2\pi(24)}{5.615} \frac{R_0}{r_p S_f} \frac{1}{t_{ne}}$ | $b_M \equiv \frac{141.2\pi(24)}{5.615} \frac{R_0}{r_p S_f} \frac{1}{t_{ne}}$ | $b_M \equiv \frac{141.2\pi(24)}{5.615} \frac{R_0}{r_p S_f} \frac{1}{t_{ne}}$ |
| 208 | $m_M$ or $m_{aM} = m_M$<br>$m_{\omega M}$ for dual porosity | $m_M \equiv \frac{(141.2)(2)(0.02878)(24)}{5.615} \frac{1}{r_p S_f \sqrt{k}}$<br>$m_{\omega M} \equiv \frac{(141.2)(2)(0.02878)(24)}{5.615} \frac{1}{r_p S_f \sqrt{\omega k}}$ | $m_M \equiv \frac{(141.2)(2)(0.02878)(24)}{5.615} \frac{1}{r_p S_f \sqrt{k}}$<br>$m_{\omega M} \equiv \frac{(141.2)(2)(0.02878)(24)}{5.615} \frac{1}{r_p S_f \sqrt{\omega k}}$ | $m_M \equiv \frac{(141.2)(2)(0.02878)(24)}{5.615} \frac{1}{r_p S_f \sqrt{k}}$<br>$m_{\omega M} \equiv \frac{(141.2)(2)(0.02878)(24)}{5.615} \frac{1}{r_p S_f \sqrt{\omega k}}$ |

Table 2B (cont'd)—Equations for before-closure pressure-transient fracture-injection/falloff analysis.

200

FIGURE 3

METHODS AND APPARATUS FOR ESTIMATING PHYSICAL PARAMETERS OF RESERVOIRS USING PRESSURE TRANSIENT FRACTURE INJECTION/FALLOFF TEST ANALYSIS

FIELD OF THE INVENTION

The present invention pertains generally to the field of oil and gas subsurface earth formation evaluation techniques and more particularly to a method and an apparatus for evaluating physical parameters of a reservoir using pressure transient fracture injection/falloff test analysis. More specifically, the invention relates to improved methods and apparatus using graphs of transformed pressure and time to estimate permeability and fracture-face resistance of a reservoir.

BACKGROUND OF THE INVENTION

The oil and gas products that are contained, for example, in sandstone earth formations, occupy pore spaces in the rock. The pore spaces are interconnected and have a certain permeability, which is a measure of the ability of the rock to transmit fluid flow. When some damage has been done to the formation material immediately surrounding the bore hole during the drilling process or if permeability is low, a hydraulic fracturing operation can be performed to increase the production from the well. Hydraulic fracturing is a process by which a fluid under high pressure is injected into the formation to split the rock and create fractures that penetrate deeply into the formation. These fractures create flow channels to improve the near term productivity of the well.

Evaluating physical parameters of a reservoir play a key part in the appraisal of the quality of the reservoir. However, the delays linked with these types of measurements are often very long and thus incompatible with the reactivity required for the success of such appraisal developments.

One of the reasons is the complexity of a multilayer environment, it increases as the number of layers with different properties increases. Layers with different pore pressure, fracture pressure, and permeability can coexist in the same group of layers. The biggest detriment for investigating layer properties is a lack of cost-effective diagnostics for determining layer permeability, and fracture-face resistance of reservoir.

Numerous analyses have been carried out to evaluate physical parameters of a reservoir. More particularly, before-closure pressure-transient analysis has been commonly used to estimate permeability and fracture-face resistance from the pressure decline following a fracture-injection/falloff test in the reservoir.

Before-closure pressure-transient analysis is described by Mayerhofer and Economides in a paper SPE 26039 "Permeability Estimation From Fracture Calibration Treatments," presented at the 1993 Western Regional Meeting, Anchorage, Ak., 26–28 May 1993; also by Mayerhofer, Ehlig-Economides, and Economides in a journal *JPT* (March 1995) on page 229 "Pressure-Transient Analysis of Fracture-Calibration Tests"; and by Ehlig-Economides, Fan, and Economides in a paper SPE 28690 "Interpretation Model for Fracture Calibration Tests in Naturally Fractured Reservoirs" presented at the 1994 SPE International Petroleum Conference and Exhibition of Mexico, 10–13 Oct. 1994. The analysis was formulated in part using the early-time infinite-conductivity fracture solution of the partial differential equation that Gringarten, Ramey, and Raghavan suggested in a journal *SPEJ* (August 1974) on page 347 "Unsteady-State Pressure Distributions Created by a Well With a Single Infinite-Conductivity Vertical Fracture" which assumed the use of a slightly compressible reservoir fluid. However, diagnostic fracture-injection/falloff tests are commonly implemented in reservoirs containing highly compressible fluids, for example, in natural gas reservoirs. When the compressibility of the reservoir fluid deviates from the assumption of a slightly compressible fluid, the analysis methods as used in the prior art can lead to erroneous permeability and fracture-face resistance estimates.

The errors in the estimates of the permeability and fracture-face resistance are significant and can be detected in the plotting of the experimental data obtained with a slightly compressible reservoir fluid. As a matter of fact, these errors are the consequences of the inaccuracy of the approximations as used in the prior art. These approximations used in connection with the actual theory developed with the pressure-transient leakoff analysis are based on the assumption that the reservoir fluid properties are not functions of pressure, which could not be the case when the reservoir fluid is a gas. The approximations as assumed in the prior art are as follows:

1) Before-Closure Pressure-Transient Leakoff Analysis Assuming a Slightly-Compressible Reservoir Fluid The pressure decline following a fracture-injection/falloff test can be divided into two distinct regions: before-fracture closure and after-fracture closure. Before-closure pressure-transient analysis is used to determine permeability from the before-fracture closure decline data. Mayerhofer and Economides in paper SPE 26039 divide the before-closure pressure difference between a point in an open, infinite-conductivity fracture and a point in the undisturbed reservoir into four components written as:

$$\Delta p(t)=\Delta p_{res}(t)+\Delta p_{cake}(t)+\Delta p_{piz}(t)+\Delta p_{fiz}(t). \tag{1}$$

The pressure difference in the polymer invaded zone, $\Delta p_{piz}(t)$, the filtrate invaded zone, $\Delta p_{fiz}(t)$, and across the filtercake, $\Delta p_{cake}(t)$, can be grouped into a fracture-face pressure difference term, $\Delta p_{face}(t)$. Consequently, the pressure gradient consists of reservoir and fracture-face resistance components, and is written as:

$$\Delta p(t)=\Delta p_{res}(t)+\Delta p_{face}(t). \tag{2}$$

2) Fracture-Face Pressure Difference

In the same way, in paper SPE 26039 Mayerhofer and Economides determine the fracture-face resistance pressure difference by using the concept of a fracture-face skin proposed by Cinco-Ley and Samaniego in paper SPE 10179 "Transient Pressure Analysis: Finite Conductivity Fracture Case Versus Damage Fracture Case" presented at the 1981 SPE Annual Technical Conference and Exhibition, San Antonio, Tex., 5–7 Oct. 1981. Cinco-Ley and Samaniego defined fracture-face skin as:

$$s_f = \frac{\pi b_{fs}}{2L_f}\left[\frac{k}{k_{fs}} - 1\right], \tag{3}$$

where $b_{fs}$ is the damaged zone width, $L_f$ is the fracture half-length, k is the reservoir permeability, and $k_{fs}$ is the damaged-zone permeability. Mayerhofer and Economides account for variable fracture-face skin by defining resistance, in paper SPE 26039, as:

$$R_{fs}(t) = \frac{b_{fs}(t)}{k_{fs}}, \tag{4}$$

and dimensionless resistance in journal *JPT* of (March 1995) by:

$$R_D(t) = \frac{R_{fs}(t)}{R'_0} \approx \sqrt{\frac{t}{t_{ne}}}, \tag{5}$$

where $R'_0$ is the reference filtercake resistance at the end of the injection and $t_{ne}$ is the time at the end of the injection.

With Eqs. 4 and 5, fracture-face skin is written as:

$$s_f = \frac{\pi k R'_0 R_D(t)}{2L_f} - \frac{\pi b_{fs}}{2L_f} \cong \frac{\pi k R'_0 R_D(t)}{2L_f}, \tag{6}$$

or as:

$$s_f = \frac{\pi k R'_0}{2L_f}\sqrt{\frac{t}{t_{ne}}}. \tag{7}$$

Fracture-face skin is equivalent to a dimensionless pressure difference across the fracture face; thus, it can be written as:

$$p_{L_f D} = \frac{k h_p \Delta p_{face}}{141.2 q_{L_f} B \mu} = s_f, \tag{8}$$

where $h_p$ is the permeable reservoir thickness, $q_{L_f}$ is the total injection (leakoff) rate into both wings of the hydraulic fracture, B is the formation volume factor of the filtrate, and μ is the filtrate viscosity. With Eq. 8, the fracture-face pressure difference is written as:

$$\Delta p_{face} = 141.2(\pi)\frac{\mu R'_0}{h_p L_f}\frac{q_{L_f} B}{2}\sqrt{\frac{t}{t_{ne}}}. \tag{9}$$

With a fracture symmetric about the wellbore, the total injection (leakoff) rate can be written as:

$$q_{L_f} B = 2q_l. \tag{10}$$

where $q_l$ is the leakoff rate in one wing of the fracture. The fracture-face pressure difference is written as:

$$\Delta p_{face} = 141.2(\pi)\frac{\mu R'_0}{h_p L_f} q_\ell \sqrt{\frac{t}{t_{ne}}}. \tag{11}$$

Define:

$$R_0 \equiv \mu R'_0, \tag{12}$$

where $R_0$ is the fracture-face resistance, then the fracture-face pressure difference is written as:

$$\Delta p_{face} = 141.2(\pi)\frac{R_0}{h_p L_f} q_\ell \sqrt{\frac{t}{t_{ne}}}. \tag{13}$$

Assuming the fracture-face skin is a steady-state skin, the pressure difference at the fracture face at any time since the injection began is written as:

$$(\Delta p_{face})_n = 141.2(\pi)\frac{R_0}{h_p L_f}(q_\ell)_n \sqrt{\frac{t_n}{t_{ne}}}. \tag{14}$$

where the subscript n denotes a time $t_n$.

According to Nolte, K. G. in a journal *SPEFE* (December 1986): "A General Analysis of Fracturing Pressure Decline With Application to Three Models," on page 571, the leakoff rate from one wing of a hydraulic fracture during a shut-in period is written as:

$$(ql)_j = -\left[\frac{24}{5.165}\right]\frac{A_f}{S_f}\left[\frac{d(\Delta p)}{d(\Delta t)}\right]_j \cong \left[\frac{24}{5.165}\right]\frac{A_f}{S_f}\frac{(p_{j-1} - p_j)}{(t_j - t_{j-1})}. \tag{15}$$

where $A_f$ is the fracture area, $S_f$ is the fracture stiffness and the subscript j is a time index. $S_f$ can be determined using Table 1 which summarizes what Valkó and Economides determine in Chap. 2, pages 19–51: "Linear Elasticity, Fracture Shapes, and Induced Stresses," *Hydraulic Fracture Mechanics*, John Wiley & Sons, New York City (1997). The fracture stiffness $S_f$ for 2D fracture models can be calculated by using either one of the three formulas as shown in Table 1, the radial equation, the Perkins-Kern-Nordgren equation, or the Geertsma-deKlerk equation.

Define:

$$d_j \equiv \frac{(p_{j-1} - p_j)}{(t_j - t_{j-1})}, \tag{16}$$

then the leakoff rate from one wing can be written as:

$$(ql)_j = \frac{24}{5.165}\frac{A_f}{S_f} d_j. \tag{17}$$

At any time during the shut-in period, $t_n > t_{ne}$, the fracture-face pressure difference is written as:

$$(\Delta p_{face})_n = \frac{141.2(\pi)24}{5.615}\frac{A_f}{h_p L_f}\frac{R_0}{S_f} d_n \sqrt{\frac{t_n}{t_{ne}}}. \tag{18}$$

The ratio of permeable fracture area to total fracture area is defined by:

$$r_p \equiv \frac{A_p}{A_f}, \tag{19}$$

where for a rectangular-shaped fracture, $A_p = h_p L_f$, and the fracture-face pressure difference at any time during the shut-in period, $t_n > t_{ne}$, is written as:

$$(\Delta p_{face})_n = \frac{141.2(\pi)24}{5.615} \frac{R_0}{r_p S_f} d_n \sqrt{\frac{t_n}{t_{ne}}}. \tag{20}$$

Eq. 20 is also applicable to radial, elliptical, or other idealized fracture geometry by defining fracture-face skin in terms of equivalent fracture half-length, $L_e$, and noting that any fracture area can be expressed in terms of an "equivalent" rectangular fracture area.

3) Reservoir Pressure Difference

As in previously mentioned article of the journal *SPEJ* (August 1974) on page 347: "Unsteady-State Pressure Distributions Created by a Well With a Single Infinite-Conductivity Vertical Fracture", the pressure drop in the reservoir is modeled by Gringarten, Ramey, and Raghavan for a slightly-compressible fluid, and is written in dimensionless form as:

$$P_{L_f D} = \sqrt{\pi t_{L_f D}}, \tag{21}$$

where $$p_{L_f D} = \frac{k h_p \Delta p_{res}}{141.2 q_{L_f} B \mu}, \tag{22}$$

and $$t_{L_f D} = 0.0002637 \frac{kt}{\phi \mu c_t L_f^2}. \tag{23}$$

In Eq. 23, $\phi$ is the porosity and $c_t$ is the total compressibility. Equating Eqs. 21 and 22 and combining with Eq. 10 results in:

$$B \Delta p_{res} = 141.2(2) \frac{B\mu}{k h_p} q l \sqrt{\pi t_{L_f D}}. \tag{24}$$

By expanding the dimensionless time term, the reservoir pressure difference can be written as:

$$\Delta p_{res} = 141.2(2)(0.02878) \frac{1}{h_p L_f \sqrt{k}} \sqrt{\frac{\mu}{\phi c_t}}\, q l \sqrt{t}. \tag{25}$$

The pressure difference at any time $t_n$ is written using superposition as:

$$(\Delta p_{res})_n = 141.2(2)(0.02878) \frac{1}{h_p L_f \sqrt{k}} \sqrt{\frac{\mu}{\phi c_t}} \sum_{j=1}^{n} [(q_\ell)_j - (q_\ell)_{j-1}] \sqrt{t_n - t_{j-1}}. \tag{26}$$

In a simplification of the more general method, Mayerhofer and Economides in paper SPE 26039, and Valkó and Economides in a journal *SPEPF* (May 1999) on page 117: "Fluid-Leakoff Delineation in High-Permeability Fracturing", assume that during the injection, the first ne+1 leakoff rates are constant, where ne is the index corresponding to the time at the end of the injection and the beginning of the pressure falloff, the leakoff rates can be written as:

$$(q_l)_j = \text{Constant } 1 \leqq j \leqq ne+1, \text{ and } (q_l)_0 = 0. \tag{27}$$

With Eq. 27, the reservoir pressure difference at any time $t_n$ is written as:

$$(\Delta p_{res})_n = 141.2(2)(0.02878) \frac{1}{h_p L_f \sqrt{k}} \sqrt{\frac{\mu}{\phi c_t}} \left[ (q_\ell)_1 \sqrt{t_n} + [(q_\ell)_{ne+2} - (q_\ell)_{ne+1}] \sqrt{t_n - t_{ne+1}} + \sum_{j=ne+3}^{n} [(q_\ell)_j - (q_\ell)_{j-1}] \sqrt{t_n - t_{j-1}} \right]. \tag{28}$$

or written as:

$$(\Delta p_{res})_n = 141.2(2)(0.02878) \frac{1}{h_p L_f \sqrt{k}} \sqrt{\frac{\mu}{\phi c_t}} \left[ (q_\ell)_{ne+2} \sqrt{t_n - t_{ne+1}} + \sum_{j=ne+3}^{n} [(q_\ell)_j - (q_\ell)_{j-1}] \sqrt{t_n - t_{j-1}} + (q_\ell)_{ne+1} \sqrt{t_n} \left( 1 - \sqrt{1 - \frac{t_{ne+1}}{t_n}} \right) \right]. \tag{28}$$

With Eq. 17 substituted for leakoff rate and Eq. 19 for the ratio of permeable to total fracture area, the reservoir pressure difference at any time $t_n$ is written as:

$$(\Delta p_{res})_n = \frac{141.2(2)(0.02878)(24)}{5.615} \frac{1}{r_p S_f \sqrt{k}} \sqrt{\frac{\mu}{\phi c_t}} \left[ d_{ne+2} \sqrt{t_n - t_{ne+1}} + \sum_{j=ne+3}^{n} [d_j - d_{j-1}] \sqrt{t_n - t_{j-1}} + d_{ne+1} \sqrt{t_n} \left( 1 - \sqrt{1 - \frac{t_{ne+1}}{t_n}} \right) \right]. \tag{29}$$

4) Specialized Cartesian Graph for Determining Permeability and Fracture-Face Resistance Eq. 2 defines the total pressure difference between a point in the fracture and a point in the undisturbed reservoir as the sum of the reservoir and fracture-face pressure differences, which is written as:

$$(\Delta p)_n = \frac{141.2(2)(0.02878)(24)}{5.615}\frac{1}{r_p S_f\sqrt{k}}\sqrt{\frac{\mu}{\phi c_t}}\left[\begin{array}{l} d_{ne+2}\sqrt{t_n - t_{ne+1}} + \\ \sum_{j=ne+3}^{n}[d_j - d_{j-1}]\sqrt{t_n - t_{j-1}} + \\ d_{ne+1}\sqrt{t_n}\left(1-\sqrt{1-\frac{t_{ne+1}}{t_n}}\right)\end{array}\right] + \frac{141.2(\pi)24}{5.615}\frac{R_0}{r_p S_f}d_n\sqrt{\frac{t_n}{t_{ne}}} \tag{30}$$

Algebraic manipulation allows Eq. 30 to be written as:

$$\frac{(\Delta p)_n}{d_n\sqrt{t_n}\sqrt{t_{ne}}} = \frac{141.2(2)(0.02878)(24)}{5.615}\frac{1}{r_p S_f\sqrt{k}}\sqrt{\frac{\mu}{\phi c_t}}\left[\begin{array}{l}\frac{d_{ne+2}}{d_n}\left(\frac{t_n - t_{ne+1}}{t_n t_{ne}}\right)^{1/2} + \\ \sum_{j=ne+3}^{n}\frac{[d_j - d_{j-1}]}{d_n}\left(\frac{t_n - t_{j-1}}{t_n t_{ne}}\right)^{1/2} + \\ \frac{d_{ne+1}}{d_n\sqrt{t_{ne}}}\left(1-\sqrt{1-\frac{t_{ne+1}}{t_n}}\right)\end{array}\right] + \frac{141.2(\pi)24}{5.615}\frac{R_0}{r_p S_f}\frac{1}{t_{ne}} \tag{31}$$

In view of Eq. 16, the term $d_{ne+1}$ can be written in an alternative form as:

$$d_{ne+1} = \frac{5.615}{24}\frac{S_f}{A_f}\frac{24}{5.615}\frac{A_f}{S_f}d_{ne+1} = \frac{5.615}{24}\frac{S_f}{A_f}q_{ne+1}, \tag{32}$$

but recognizing that $q_{ne}=q_{ne+1}$ and $V_{Lne}=(q_l)_{ne}t_{ne}$ allows Eq. 32 to be written as:

$$d_{ne+1} = \frac{5.615}{24}\frac{S_f}{t_{ne}}\frac{V_{Lne}}{A_f}, \tag{33}$$

where $V_{Lne}$ is the leakoff volume at the end of the injection. Define lost width due to leakoff at the end of the injection as:

$$w_L \equiv \frac{V_{Lne}}{A_f}, \tag{34}$$

and Eq. 33 can be written as:

$$d_{ne+1} = \frac{5.615}{24}S_f w_L\frac{1}{t_{ne}}. \tag{35}$$

Define:

$$c_1 \equiv \sqrt{\frac{\mu}{\phi c_t}}, \tag{36}$$

$$c_2 \equiv \frac{5.165}{24}S_f w_L\sqrt{\frac{\mu}{\phi c_t}}, \tag{37}$$

$$y_n \equiv \frac{(\Delta p)_n}{d_n\sqrt{t_n}\sqrt{t_{ne}}}, \tag{38}$$

$$x_n \equiv \left[\begin{array}{l} c_1\left[\begin{array}{l}\frac{d_{ne+2}}{d_n}\left[\frac{t_n - t_{ne+1}}{t_n t_{ne}}\right]^{1/2} + \\ \sum_{j=ne+3}^{n}\frac{[d_j - d_{j-1}]}{d_n}\left(\frac{t_n - t_{j-1}}{t_n t_{ne}}\right)^{1/2}\end{array}\right] + \\ \frac{c_2}{d_n t_{ne}^{3/2}}\left(1-\sqrt{1-\frac{t_{ne+1}}{t_n}}\right)\end{array}\right], \tag{39}$$

$$m_M \equiv \frac{141.2(2)(0.02878)(24)}{5.615}\frac{1}{r_p S_f\sqrt{k}}, \tag{40}$$

and $$b_M \equiv \frac{141.2(\pi)24}{5.615}\frac{R_0}{r_p S_f}\frac{1}{t_{ne}}. \tag{41}$$

Combining Eq. 31 and Eqs. 36 through 41 results in:

$$y_n = m_M x_n + b_M. \tag{42}$$

Eq. 42 suggests a graph of $y_n$ versus $x_n$ using the observed fracture-injection/falloff before-closure data will result in a straight line with the slope a function of permeability and the intercept a function of fracture-face resistance. Eqs. 41 and 42 are used to determine permeability and fracture-face resistance from the slope and intercept of a straight-line through the observed data.

5) Before-Closure Pressure-Transient Leakoff Analysis in a Dual-Porosity Reservoir System In the present application, dual porosity refers to a mathematical model of a naturally fractured reservoir system. In paper SPE 28690, Ehlig-Economides, Fan, and Economides formulated the Mayerhofer and Economides model for dual-porosity reservoirs using Cinco-Ley and Meng's dimensionless pressure. In a paper SPE 18172: "Pressure Transient Analysis of Wells With Finite Conductivity Vertical Fractures in Dual Porosity Reservoirs," presented at the 1988 SPE Annual Technical Conference and Exhibition, Houston, Tex., 2–5 Oct. 1988, Cinco-Ley and Meng determine dimensionless pressure with an early-time approximation for flow of a slightly compressible fluid from an infinite-conductivity fracture as:

$$p_{L_f D} = \sqrt{\frac{\pi t_{L_f D}}{\omega}}, \tag{43}$$

where for dual-porosity reservoirs, $$p_{L_f D} = \frac{k_{fb}h_p\Delta p_{res}}{141.2 q_{L_f} B\mu}, \tag{44}$$

-continued $$t_{L_fD} = 0.0002637\frac{k_{fb}t}{\phi\mu c_t L_f^2}, \tag{45}$$

and ω is the natural fracture storativity ratio as defined by Warren, J. E. and Root, P. J. in a journal *SPEJ* (September 1963) on page 245: "The Behavior of Naturally Fractured Reservoirs".

Writing Eq. 43 as $$\omega p_{L_fD} = \sqrt{\pi\omega t_{L_fD}}, \tag{46}$$

and repeating the derivation for the reservoir pressure difference results in changing the final slope definition, Eq. 40, to:

$$m_M \equiv \frac{141.2(2)(0.02878)(24)}{5.615}\frac{1}{r_p S_f\sqrt{\omega k_{fb}}}. \tag{47}$$

In a dual-porosity reservoir or in a naturally fractured reservoir system, before-closure pressure-transient leakoff analysis using the specialized Cartesian graph results in an estimate of $\omega k_{fb}$. Methods as used in the prior art allow the product to be evaluated without an acceptable accuracy, and estimating fracture storativity ω or bulk-fracture permeability $k_{fb}$ requires additional testing which would involve additional inaccuracy. Therefore, since the permeability and fracture-face resistance evaluations cannot be directly obtained and since the additional testing increase the error of these evaluations, it is necessary to determine the product $\omega k_{fb}$ with more accuracy.

Henceforth, there is a need to find another approach that mitigates nonideal leakoff behavior attributed to pressure-dependent fluid properties with more accuracy. For example, in low pressure gas reservoirs, that is, in many gas reservoirs with a pore pressure less than about 3000 psi, reservoir fluid properties are strong functions of pressure. When fluid properties are strong functions of pressure, assuming constant properties for use in pressure and time formulations will cause significant error in permeability and fracture-face resistance determinations.

These approximations as used in the prior art are therefore unsatisfactory. Thus, there is a desire not only for estimating accurate permeability and fracture-face resistance of a reservoir to appraise its quality but also for avoiding the delays linked with this type of measurements which are often very long and incompatible with the reactivity required for the success of such appraisal developments. New, faster and accurate evaluation means are therefore sought as a decision-making support.

SUMMARY OF THE INVENTION

The present invention pertains to a method and an apparatus for evaluating physical parameters of a reservoir using pressure transient fracture injection/falloff test analysis.

The before-closure pressure-transient leakoff analysis for a fracture-injection/falloff test is used to mitigate the detrimental effects of pressure-dependent fluid properties on the evaluation of the permeability and fracture-face resistance of a reservoir. A fracture-injection/falloff test consists of an injection of liquid, gas, or a combination (foam, emulsion, etc.) containing desirable additives for compatibility with the formation at an injection pressure exceeding the formation fracture pressure followed by a shut-in period. The pressure falloff during the shut-in period is measured and analyzed to determine permeability and fracture-face resistance by preparing a specialized Cartesian graph from the shut-in data using adjusted pseudovariables such as adjusted pseudopressure data and adjusted pseudotime data. This analysis allows the data on the graph to fall along a straight line with either constant or pressure-dependent fluid properties. The slope and the intercept of the straight line are respectively indicative of the permeability and fracture-face resistance evaluations.

Pseudovariable formulations for before-closure pressure-transient fracture-injection/falloff test analysis minimize error associated with pressure-dependent fluid properties by removing the "nonlinearity". The use of adjusted pseudovariables according to the present invention allows analysis to be carried out when a compressible or slightly compressible fluid is injected into a reservoir containing a compressible fluid. Therefore, the permeability and the fracture-face resistance of the reservoir can be estimated with more accuracy by the pressure transient fracture injection/falloff test.

Although the primary benefit occurs when the reservoir fluid is highly compressible, the technique is also valid for all reservoir fluids that are either compressible or slightly compressible.

In accordance with a first aspect of the present invention, a method of estimating physical parameters of porous rocks of a subterranean formation containing a compressible reservoir fluid comprising the steps of injecting an injection fluid into the subterranean formation at an injection pressure exceeding the subterranean formation fracture pressure, shutting in the subterranean formation, gathering pressure measurement data over time from the subterranean formation during shut-in, transforming the pressure measurement data into corresponding adjusted pseudopressure data to minimize error associated with pressure-dependent reservoir fluid properties, and determining the physical parameters of the subterranean formation from the adjusted pseudopressure data.

In an embodiment, the adjusted pseudopressure data is defined by the equation:

$$(p_a)_n = \frac{\overline{\mu}_g\overline{c}_t}{\overline{p}}\int_0^{(p_w)_n}\frac{pdp}{\mu_g c_t}.$$

Furthermore, the determination of the physical parameters is obtained by a plot of the adjusted pseudopressure data over time showing a straight line characterized by a slope $m_M$ and an intercept $b_M$, wherein $m_M$ is a function of permeability k and $b_M$ is a function of fracture-face resistance $R_0$ wherein:

$$k = \left[\frac{(141.2)(2)(0.02878)(24)}{5.615}\frac{1}{r_p S_f m_M}\right]^2;$$

$$R_0 = \frac{5.615}{141.2\pi(24)}r_p S_f t_{ne} b_M.$$

In accordance with a second aspect of the present invention, a method of estimating physical parameters of porous rocks of a subterranean formation containing a compressible reservoir fluid comprising the steps of injecting an injection fluid into the subterranean formation at an injection pressure exceeding the subterranean formation fracture pressure, shutting in the subterranean formation, gathering pressure measurement data over time from the subterranean formation during shut-in, transforming the pressure measurement data into corresponding adjusted pseudopressure data and time into adjusted pseudotime data to minimize error associated with pressure-dependent reservoir fluid properties, and determining the physical parameters of the subterranean formation from the adjusted pseudopressure data.

In an embodiment, the adjusted pseudopressure data and the adjusted pseudotime are defined by the equations:

$$(t_a)_n = (\mu_g c_t)_0 \int_0^{(\Delta t)_n} \frac{d\Delta t}{(\mu_g c_t)_w}, \text{ and}$$

$$(p_a)_n = \frac{\overline{\mu}_g \overline{c}_t}{\overline{p}} \int_0^{(p_w)_n} \frac{p dp}{\mu_g c_t}.$$

Furthermore, the determination of the physical parameters is obtained by a plot of the adjusted pseudopressure data over adjusted pseudotime data showing a straight line characterized by a slope $m_M$ and an intercept $b_M$, wherein $m_M$ is a function of permeability k and $b_M$ is a function of fracture-face resistance $R_0$ wherein:

$$k = \left[\frac{(141.2)(2)(0.02878)(24)}{5.615} \frac{1}{r_p S_f m_M}\right]^2;$$

$$R_0 = \frac{5.615}{141.2\pi(24)} r_p S_f t_{ne} b_M.$$

Also in one embodiment, the reservoir fluid is compressible or slightly compressible.

And in another embodiment, the injection fluid is compressible or slightly compressible.

In accordance with a third aspect of the present invention, a system for estimating physical parameters of porous rocks of a subterranean formation containing a compressible reservoir fluid comprising a pump for injecting an injection fluid into the subterranean formation at an injection pressure exceeding the subterranean formation fracture pressure, means for gathering pressure measurement data from the subterranean formation during a shut-in period, means for transforming the pressure measurement data into adjusted pseudopressure data to minimize error associated with pressure-dependent reservoir fluid properties and means for determining the physical parameters of the subterranean formation from the adjusted pseudopressure data.

In an embodiment, the determining means comprises graphics means for plotting a graph of the adjusted pseudopressure data over time, the graph representing a straight line with a slope $m_M$ and an intercept $b_M$ wherein $m_M$ is a function of permeability k and $b_M$ is a function of fracture-face resistance $R_0$.

In accordance with a fourth aspect of the present invention, a system for estimating physical parameters of porous rocks of a subterranean formation containing a compressible reservoir fluid comprising a pump for injecting an injection fluid into the subterranean formation at an injection pressure exceeding the subterranean formation fracture pressure, means for gathering pressure measurement data from the subterranean formation during a shut-in period, means for transforming the pressure measurement data into adjusted pseudopressure data and time into adjusted pseudotime to minimize error associated with pressure-dependent reservoir fluid properties and means for determining the physical parameters of the subterranean formation from the adjusted pseudopressure data.

In an embodiment, the determining means comprises graphics means for plotting a graph of the adjusted pseudopressure data over adjusted pseudotime data, the graph representing a straight line with a slope $m_M$ and an intercept $b_M$ wherein $m_M$ is a function of permeability k and $b_M$ is a function of fracture-face resistance $R_0$.

Also in another embodiment, the reservoir fluid is compressible or slightly compressible.

And in another embodiment, the injection fluid is compressible or slightly compressible.

Other aspects and features of the invention will become apparent from consideration of the following detailed description taken in conjunction with the accompanying drawings.

BRIEF DESCRIPTION OF THE DRAWINGS

A more complete understanding of the present disclosure and advantages thereof may be acquired by referring to the following description taken in conjunction with the accompanying drawings wherein:

FIG. 1 shows a Table 1 representing three formulas used for the calculation of fracture stiffness for 2D fracture models.

FIG. 2 shows a Table 2A which lists equations and definitions for before-closure pressure-transient fracture injection/falloff test analysis.

FIG. 3 shows a Table 2B which lists additional equations and definitions for before-closure pressure-transient fracture injection/falloff test analysis.

Figure 4:
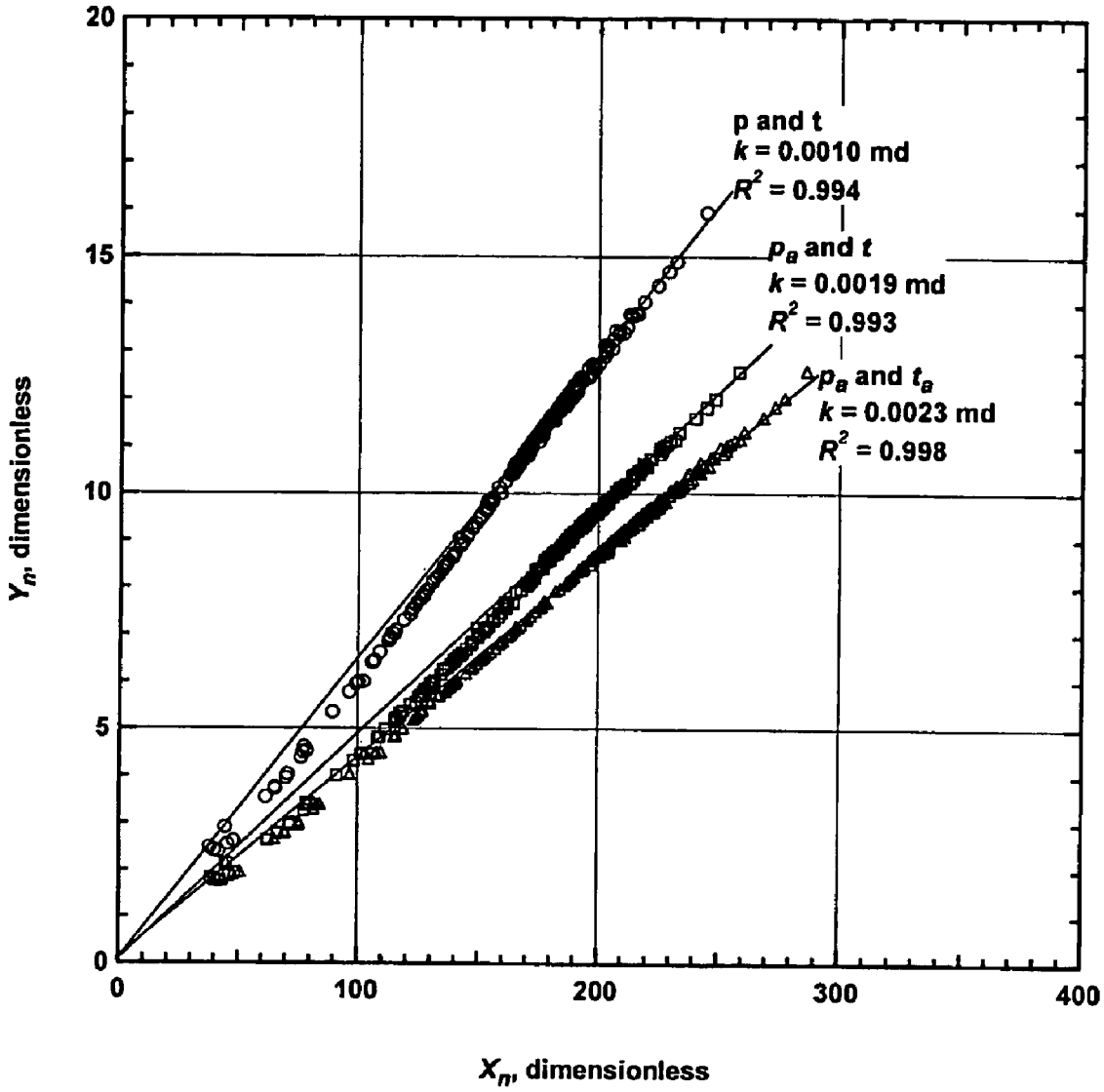
FIG. 4 shows a plotting of three specialized Cartesian graphs of the basic linear equations $y_n$ versus $x_n$ according to a first series of experiments.

The present invention may be susceptible to various modifications and alternative forms. Specific embodiments of the present invention are shown by way of example in the drawings and are described herein in detail. It should be understood, however, that the description set forth herein of specific embodiments is not intended to limit the present invention to the particular forms disclosed. Rather, all modifications, alternatives and equivalents falling within the spirit and scope of the invention as defined by the appended claims are intended to be covered.

DESCRIPTION OF THE EMBODIMENTS OF THE INVENTION

The methods as shown in the prior art for analyzing the before-closure pressure decline following a fracture-injection/falloff test do not consider a compressible reservoir fluid with either a slightly compressible or compressible injection fluid. Accounting for compressible fluids is accomplished by using pseudovariables, or for convenience, adjusted pseudovariables in the derivation.

Pseudovariables have been demonstrated in other well testing applications as removing the "nonlinearity" associated with pressure-dependent fluid properties, and using pseudovariable formulations for before-closure pressure-transient fracture-injection/falloff test analysis will minimize error associated with pressure-dependent fluid properties. Definitions of pseudovariables and adjusted pseudovariables can respectively be found in a paper SPE 8279 by Agarwal, R. G.: "Real Gas Pseudo-time—A New Function for Pressure Buildup Analysis of MHF Gas Wells" presented at the 1979 SPE Annual Fall Technical Conference and Exhibition, Las Vegas, Nev., 23–26 Sep. 1979, and in a journal *PEFE* (December 1987) on page 629 by Meunier, D. F., Kabir, C. S., and Wittman, M. J.: "Gas Well Test Analysis: Use of Normalized Pseudovariables".

As a matter of fact, since Gas viscosity, deviation factor (z), and compressibility are functions of pressure; thus the governing partial differential equation is nonlinear. Therefore, pseudopressure and pseudotime are required to linearize the partial differential equation corresponding to the solution that Gringarten, Ramey, and Raghavan suggested in previously mentioned journal SPEJ (August 1974). Pseudopressure "corrects" for gas viscosity and real-gas deviation factor, and pseudotime "corrects" for gas viscosity and gas compressibility. Some authors find the use of pseudotime unnecessary as gas compressibility is nearly constant in most applications; however, both pseudopressure and pseudotime must be used to rigorously transform the governing partial differential equation to a linear partial differential equation.

Using both pseudopressure and pseudotime enables well design engineers to obtain the best "correct" answer. However acceptable answers may be obtained using only pseudopressure. Two series of experiment will be shown later in FIGS. 4 and 5 which illustrate three graphs resulting in the evaluation of permeability and fracture-face resistance when pressure and time; pseudopressure and time; and finally pseudopressure and pseudotime formulations represent the variables.

1) Reservoir Adjusted Pseudopressure Variables Difference

For convenience, the new approach is illustrated with adjusted pseudovariables. The pressure drop in the reservoir modeled by Gringarten, Ramey, and Raghavan in *SPEJ* (August 1974) for a slightly-compressible fluid, is written in dimensionless form as:

$$p_{L_fD}=\sqrt{\pi t_{L_fD}}. \qquad \text{(48), the same as Eq. 21.}$$

Writing Eq. 48 in terms of pseudopressure accounts for the variation of viscosity and gas deviation factor for the compressible fluid in the reservoir. Define adjusted pseudopressure variable as:

$$p_a = \frac{\bar{\mu}_g \bar{z}}{\bar{p}} \int_0^p \frac{p\,dp}{\mu_g z}, \tag{49}$$

where z is the gas deviation factor, $\bar{\mu}$ is the viscosity evaluated at average reservoir pressure, $\bar{z}$ is the gas deviation factor at average reservoir pressure, and $\bar{p}$ is average reservoir pressure. The derivative of Eq. 49 is written as:

$$\frac{dp_a}{dp} = \frac{\bar{\mu}\bar{z}}{\bar{p}}\frac{p}{\mu z} = \frac{\bar{\mu}}{\mu}\frac{\bar{B}}{B} \cong \frac{\Delta p_a}{\Delta p}. \tag{50}$$

With Eq. 50, the definition of dimensionless pressure is written as:

$$P_{L_fD} = \frac{kh_p\Delta p}{141.2(q_{L_f})_g B_g\mu_g} = \frac{kh_p\Delta p_a}{141.2(q_{L_f})_g \bar{B}_g\bar{\mu}_g} = p_{aL_fD}, \tag{51}$$

which when combined with Eq. 48 results in:

$$p_{aL_fD}=\sqrt{\pi t_{L_fD}}. \tag{52}$$

The reservoir pressure difference in terms of adjusted pseudopressure variable can now be written as:

$$(\Delta p_a)_{res} = 141.2\frac{\bar{B}_g\bar{\mu}_g}{kh_p}(q_{L_f})_g\sqrt{\pi t_{L_fD}}. \tag{53}$$

With Eq. 10, the reservoir adjusted pseudopressure variable difference is written as:

$$(\Delta p_a)_{res} = 141.2(2)\frac{\bar{B}_g\bar{\mu}_g}{kh_p}\frac{(q_\ell)_g}{B_g}\sqrt{\pi t_{L_fD}}. \tag{54}$$

Dimensionless time is evaluated at average reservoir pressure, that is, dimensionless time is written as:

$$t_{L_fD} = \frac{0.0002637\,kt}{\phi\bar{\mu}_g\bar{c}_t L_f^2}, \tag{55}$$

and the reservoir adjusted pseudopressure variable difference is written as:

$$(\Delta p_a)_{res} = 141.2(2)(0.02878)\frac{1}{h_pL_f\sqrt{k}}\sqrt{\frac{\bar{\mu}_g}{\phi\bar{c}_t}}\frac{\bar{B}_g}{B_g}(q_\ell)_g\sqrt{t}. \tag{56}$$

The reservoir adjusted pseudopressure variable difference at any time $t_n$ is written using superposition as:

$$[(\Delta p_a)_{res}]_n = 141.2(2)(0.02878)\frac{\bar{B}_g}{h_pL_f\sqrt{k}}\sqrt{\frac{\bar{\mu}_g}{\phi\bar{c}_t}}\sum_{j=1}^{n}\left[\left(\frac{(q_\ell)_g}{B_g}\right)_j-\left(\frac{(q_\ell)_g}{B_g}\right)_{j-1}\right]\sqrt{t_n-t_{j-1}}. \tag{57}$$

The Valkó and Economides assumption, in *SPEPF* (May 1999), that the first ne+1 leakoff rates are constant is modified such that the first ne+1 leakoff rates are constant at standard conditions. The assumption can now be expressed as:

$$\left(\frac{(q_\ell)_g}{B_g}\right)_j = \text{Constant } 1 \le j \le ne+1, \tag{58}$$

and implies that the pressure in the fracture during the injection is approximately constant. With Eq. 58, the reservoir adjusted pseudopressure variable difference at any time $t_n$ is written as:

$$[(\Delta p_a)_{res}]_n = 141.2(2)(0.02878)\frac{\overline{B}_g}{h_p L_f\sqrt{k}}\sqrt{\frac{\overline{\mu}_g}{\phi\overline{c}_t}}\left[\begin{array}{l}\left(\frac{(q_\ell)_g}{B_g}\right)_1\sqrt{t_n} + \left[\left(\frac{(q_\ell)_g}{B_g}\right)_{ne+2} - \left(\frac{(q_\ell)_g}{B_g}\right)_{ne+1}\right]\sqrt{t_n - t_{ne+1}} + \\ \sum_{j=ne+3}^{n}\left[\left(\frac{(q_\ell)_g}{B_g}\right)_j - \left(\frac{(q_\ell)_g}{B_g}\right)_{j-1}\right]\sqrt{t_n - t_{j-1}}\end{array}\right] \text{ or:} \tag{59}$$

$$[(\Delta p_a)_{res}]_n = 141.2(2)(0.02878)\frac{\overline{B}_g}{h_p L_f\sqrt{k}}\sqrt{\frac{\overline{\mu}_g}{\phi\overline{c}_t}}\left[\begin{array}{l}\left(\frac{(q_\ell)_g}{B_g}\right)_{ne+2}\sqrt{t_n - t_{ne+1}} + \\ \sum_{j=ne+3}^{n}\left[\left(\frac{(q_\ell)_g}{B_g}\right)_j - \left(\frac{(q_\ell)_g}{B_g}\right)_{j-1}\right]\sqrt{t_n - t_{j-1}} + \\ \left(\frac{(q_\ell)_g}{B_g}\right)_{ne+1}\sqrt{t_n}\left(1 - \sqrt{1 - \frac{t_{ne+1}}{t_n}}\right)\end{array}\right], \tag{60}$$

The leakoff rate shown in Eq. 15 must be expressed in terms of adjusted pseudopressure variable, and is written as:

$$[(q_\ell)_g]_j = \left[\frac{24}{5.615}\right]\frac{A_f}{S_f}\frac{(\mu_g B_g)_j}{\overline{\mu}_g\overline{B}_g}\frac{(p_a)_{j-1} - (p_a)_j}{t_j - t_{j-1}}. \tag{61}$$

Define:

$$(d_a)_j \equiv \frac{(\mu_g)_j}{\overline{\mu}_g}\frac{(p_a)_{j-1} - (p_a)_j}{t_j - t_{j-1}}, \tag{62}$$

then Eq. 61 can be written as:

$$[(q_\ell)_g]_j = \left[\frac{24}{5.615}\right]\frac{A_f}{S_f}\frac{(B_g)_j}{\overline{B}_g}(d_a)_j. \tag{63}$$

With Eq. 63, the reservoir adjusted pseudopressure variable difference at any time $t_n$ is written using superposition as:

$$[(\Delta p_a)_{res}]_n = \frac{141.2(2)(0.02878)(24)}{5.615}\frac{A_f}{h_p L_f}\frac{1}{S_f\sqrt{k}} \tag{64}$$

-continued $$\sqrt{\frac{\overline{\mu}_g}{\phi\overline{c}_t}}\left[\begin{array}{l}(d_a)_{ne+2}\sqrt{t_n - t_{ne+1}} + \\ \sum_{j=ne+3}^{n}[(d_a)_j - (d_a)_{j-1}]\sqrt{t_n - t_{j-1}} + \\ (d_a)_{ne+1}\sqrt{t_n}\left(1 - \sqrt{1 - \frac{t_{ne+1}}{t_n}}\right)\end{array}\right],$$

or with Eq. 19, written as:

$$[(\Delta p_a)_{res}]_n = \frac{141.2(2)(0.02878)(78)(24)}{5.615}\frac{1}{r_p S_f\sqrt{k}}\sqrt{\frac{\overline{\mu}_g}{\phi\overline{c}_t}}\left[\begin{array}{l}(d_a)_{ne+2}\sqrt{t_n - t_{ne+1}} + \\ \sum_{j=ne+3}^{n}[(d_a)_j - (d_a)_{j-1}]\sqrt{t_n - t_{j-1}} + \\ (d_a)_{ne+1}\sqrt{t_n}\left(1 - \sqrt{1 - \frac{t_{ne+1}}{t_n}}\right)\end{array}\right]. \tag{65}$$

2) Fracture-Face Adjusted Pseudopressure Variable Difference

The fracture-face adjusted pseudopressure variable difference is developed beginning from Eq. 8, which is written in terms of adjusted pseudopressure variable as:

$$p_{aL_fD} = \frac{kh_p(\Delta p_a)_{face}}{141.2(q_{L_f})_g\overline{B}_g\overline{\mu}_g} = s_f, \tag{66}$$

or:

$$(\Delta p_a)_{face} = 141.2(\pi)\frac{\overline{B}_g\overline{\mu}_g R'_0}{h_p L_f}\frac{(q_{L_f})_g}{2}\sqrt{\frac{t}{t_{ne}}}. \tag{67}$$

With Eq. 10 written for gas, the fracture-face adjusted pseudopressure variable difference is written as:

$$(\Delta p_a)_{face} = 141.2(\pi)\frac{\overline{B}_g\overline{\mu}_g R'_0}{h_p L_f}\frac{(q_\ell)_g}{B_g}\sqrt{\frac{t}{t_{ne}}}, \tag{68}$$

and assuming a steady-state fracture-face skin, written as:

$$[(\Delta p_a)_{face}]_n = 141.2(\pi)\frac{\overline{B}_g\overline{\mu}_g R'_0}{h_p L_f}\left[\frac{(q_\ell)_g}{B_g}\right]_n\sqrt{\frac{t_n}{t_{ne}}}, \tag{69}$$

for any time $t_n$.

Define:

$$R_0 \equiv \overline{\mu}R'_0, \tag{70}$$

and the fracture-face adjusted pseudopressure variable difference is written as:

$$[(\Delta p_a)_{face}]_n = 141.2(\pi)\frac{\overline{B}_g R_0}{h_p L_f}\left[\frac{(q_\ell)_g}{B_g}\right]_n\sqrt{\frac{t_n}{t_{ne}}}. \tag{71}$$

With Eq. 60 for the leakoff rate in terms of adjusted pseudopressure variable, the fracture-face adjusted pseudopressure variable difference is written as:

$$[(\Delta p_a)_{face}]_n = \frac{141.2(\pi)(24)}{5.615}\frac{A_f}{h_p L_f}\frac{R_0}{S_f}(d_a)_n\sqrt{\frac{t_n}{t_{ne}}}, \tag{72}$$

or $$[(\Delta p_a)_{face}]_n = \frac{141.2(\pi)(24)}{5.615}\frac{R_0}{r_p S_f}(d_a)_n\sqrt{\frac{t_n}{t_{ne}}}. \tag{73}$$

3) Specialized Cartesian Graph for Determining Permeability and Fracture-Face Resistance in Terms of Adjusted Pseudopressure Variable Eq. 2 defines the total pressure difference between a point in the fracture and a point in the undisturbed reservoir as the sum of the reservoir and fracture-face pressure differences, which is written in terms of adjusted pseudopressure variable as:

$$\Delta p_a(t)=(\Delta p_a)_{res}(t)+(\Delta p_a)_{face}(t). \tag{74}$$

Combining Eqs. 65, 73, and 74 results in the adjusted pseudopressure variable difference at any time $t_n$, which is written as:

$$(\Delta p_a)_n = \frac{141.2(2)(0.02878)(24)}{5.615}\frac{1}{r_p S_f\sqrt{k}}\sqrt{\frac{\mu_g}{\phi c_t}}\left[\begin{array}{l}(d_a)_{ne+2}\sqrt{t_n-t_{ne+1}}+\\ \sum_{j=ne+3}^{n}[(d_a)_j-(d_a)_{j-1}]\sqrt{t_n-t_{j-1}}+\\ (d_a)_{ne+1}\sqrt{t_n}\left(1-\sqrt{1-\frac{t_{ne+1}}{t_n}}\right)\end{array}\right]+\frac{141.2(\pi)(24)}{5.615}\frac{R_0}{r_p S_f}(d_a)_n\sqrt{\frac{t_n}{t_{ne}}} \tag{75}$$

Algebraic manipulation of Eq. 75 results in:

$$\frac{(\Delta p_a)_n}{(d_a)_n\sqrt{t_n}\sqrt{t_{ne}}} = \frac{141.2(2)(0.02878)(24)}{5.615}\frac{1}{r_p S_f\sqrt{k}}\sqrt{\frac{\bar{\mu}_g}{\phi\bar{c}_t}}\left[\begin{array}{l}\frac{(d_a)_{ne+2}}{(d_a)_n}\left(\frac{t_n-t_{ne+1}}{t_n t_{ne}}\right)^{1/2}+\\ \sum_{j=ne+3}^{n}\left[\frac{(d_a)_j-(d_a)_{j-1}}{(d_a)_n}\right]\left(\frac{t_n-t_{j-1}}{t_n t_{ne}}\right)^{1/2}+\\ \frac{(d_a)_{ne+1}}{(d_a)_n\sqrt{t_{ne}}}\left(1-\sqrt{1-\frac{t_{ne+1}}{t_n}}\right)\end{array}\right]+\frac{141.2(\pi)(24)}{5.615}\frac{R_0}{r_p S_f}\frac{1}{t_{ne}}. \tag{76}$$

The term $(d_a)_{ne+1}$ can be written in an alternative form as:

$$(d_a)_{ne+1} = \frac{5.615}{24}\frac{S_f}{A_f}\frac{\bar{B}_g}{(B_g)_{ne+1}}\frac{24}{5.615}\frac{A_f}{S_f}\frac{(B_g)_{ne+1}}{\bar{B}_g}(d_a)_{ne+1} = \frac{5.615}{24}\frac{S_f}{A_f}\frac{\bar{B}_g}{(B_g)_{ne+1}}[(q_\ell)_g]_{ne+1}, \tag{77}$$

but recognizing that $[(q_l)_g/B]_{ne}=[(q_l)_g/B]_{ne+1}$ and $V_{Lne}=[(q_l)_g]_{ne}t_{ne}$ allows Eq. 77 to be written as:

$$(d_a)_{ne+1} = \frac{5.615}{24}\frac{S_f}{t_{ne}}\frac{\bar{B}_g}{(B_g)_{ne}}\frac{V_{Lne}}{A_f}, \tag{78}$$

where $V_{Lne}$ is the leakoff volume at the end of the injection. Define lost width due to leakoff at the end of the injection as:

$$w_L \equiv \frac{V_{Lne}}{A_f}, \tag{79}$$

and Eq. 78 can be written as:

$$(d_a)_{ne+1} = \frac{5.615}{24}S_f w_L\frac{\bar{B}_g}{(B_g)_{ne}}\frac{1}{t_{ne}}. \tag{80}$$

Define:

$$c_{a1} \equiv \sqrt{\frac{\bar{\mu}_g}{\phi\bar{c}_t}}, \tag{81}$$

$$c_{a2} \equiv \frac{5.615}{24}S_f w_L\frac{\bar{B}_g}{(B_g)_{ne}}\sqrt{\frac{\bar{\mu}_g}{\phi\bar{c}_t}}, \tag{82}$$

$$(y_a)_n \equiv \frac{(\Delta p_a)_n}{(d_a)_n\sqrt{t_n}\sqrt{t_{ne}}}, \tag{83}$$

$$(x_a)_n \equiv \left[\begin{array}{l}c_{a1}\left[\begin{array}{l}\frac{(d_a)_{ne+2}}{(d_a)_n}\left(\frac{t_n-t_{ne+1}}{t_n t_{ne}}\right)^{1/2}+\\ \sum_{j=ne+3}^{n}\frac{[(d_a)_j-(d_a)_{j-1}]}{(d_a)_n}\left(\frac{t_n-t_{j-1}}{t_n t_{ne}}\right)^{1/2}\end{array}\right]+\\ \frac{c_{a2}}{(d_a)_n t_{ne}^{3/2}}\left[1-\left(1-\frac{t_{ne+1}}{t_n}\right)^{1/2}\right]\end{array}\right], \tag{84}$$

and recall:

$$m_M \equiv \frac{141.2(2)(0.02878)(24)}{5.615}\frac{1}{r_p S_f\sqrt{k}}, \tag{85}$$

and $$b_M \equiv \frac{141.2(\pi)24}{5.615}\frac{R_0}{r_p S_f}\frac{1}{t_{ne}}. \tag{86}$$

Combining Eq. 76 and Eqs. 80 through 86 results in:

$$(y_a)_n=m_M(x_a)_n+b_M. \tag{87}$$

Eq. 42 suggests a graph of $(y_a)_n$ versus $(x_a)_n$ using the observed fracture-injection/falloff before-closure data will result in a straight line with the slope a function of permeability and the intercept a function of fracture-face resistance, keeping in mind that the formulations of the slope does not change with the use of pseudovariables such that $m_M$, $m_{aM}$ and $m_{apM}$ are the same, but the values of the slope will change using the transformed pressure measurement data. Eqs. 86 and 87 are used to determine permeability and fracture-face resistance from the slope and intercept of a straight-line through the observed data.

4) Before-Closure Pressure-Transient Leakoff Analysis in Dual-Porosity Reservoirs in Terms of Adjusted Pseudopressure Variable In dual-porosity reservoir systems, before-closure pressure-transient analysis in terms of adjusted pseudopressure variable changes by only one equation from the single-porosity case. Eq. 85 is modified and written as $$m_{aM} \equiv \frac{141.2(2)(0.02878)(24)}{5.615} \frac{1}{r_p S_f \sqrt{\omega k_{fb}}}. \tag{88}$$

Consequently, the product of natural fracture storativity and bulk fracture permeability is determined from before-closure pressure-transient leakoff analysis in terms of adjusted pseudopressure variable in dual-porosity reservoir systems.

A similar derivation can be used to derive the equations written in terms of adjusted pseudopressure and adjusted pseudotime variables. A similar derivation could also be used to demonstrate that other before-closure pressure transient analysis formulations can be expressed in terms of pseudovariables, but since most of the steps are the same, it would be redundant to repeat each derivation.

Table 2A in FIG. 2 defines the parameters and variables used in the linear equations $y_n$ versus $x_n$ required for preparing the specialized Cartesian graphs in terms of pressure and time on a first column 212; adjusted pseudopressure variable and time on a second column 213; and adjusted pseudopressure and adjusted pseudotime variables on a third column 214.

For each of the three columns, pressure and time 212, adjusted pseudopressure variable and time 213, adjusted pseudopressure and adjusted pseudotime variables 214, the coefficients corresponding to the basic straight line equations are defined. These basic equations as shown in row 201, are respectively: $y_n=b_M+m_M x_n$, $(y_a)_n=b_M+m_M(x_a)_n$ and $(y_{ap})_n=b_M+m_M(x_{ap})_n$.

In the second row 202, the formulas of the before-closure pressure-transient analysis variable and adjusted variable with time and adjusted pseudotime variable $y_n$, $(y_a)_n$, or $(y_{ap})_n$ are respectively given as function of pressure p, pressure in reservoir $p_r$ and adjusted pseudopressure variable $p_a$ and $p_{ar}$, and time at time step $t_n$ and at the end of an injection $t_{ne}$.

In the same way, in the third row 203, the formulas of the before-closure pressure-transient analysis variables and adjusted variables with time and adjusted pseudotime variable $x_n$, $(x_a)_n$, or $(x_{ap})_n$ are respectively given as functions of coefficients $(d_a)$, $(d_{ap})$, $(c_1)$, $(c_{a1})$, $(c_{ap1})$, $(c_2)$, $(c_{a2})$, $(c_{ap2})$ at time step $t_n$, at the end of an injection $t_{ne}$, or at the end of an adjusted pseudotime variable $(t_a)_n$ and $(t_a)_{ne}$.

Table 2B in FIG. 3 defines the parameters and variables used in the basic linear equations $y_n$ versus $x_n$ required for preparing the specialized Cartesian graphs in terms of pressure and time in column 212; adjusted pseudopressure variable and time in column 213; and adjusted pseudopressure and adjusted pseudotime variables in column 214.

In rows 204, 205 and 206, the formulas corresponding to coefficients d, $(c_1)$, and $(c_2)$ are given in the case of pressure and time variables in column 212; coefficients $(d_a)$, $(c_{a1})$, $(c_{a2})$, in the case of adjusted pseudopressure variable and time in column 213; and $(d_{ap})$, $(c_{ap1})$, $(c_{ap2})$ in the case of adjusted pseudopressure and adjusted pseudotime variables in column 214.

In rows 207 and 208, the formulas of the slopes $m_M$ and $m_{\omega M}$ for dual porosity reservoir and intercepts $b_M$ are given in the case of pressure and time variables in column 212; adjusted pseudopressure variable and time in column 213; and adjusted pseudopressure and adjusted pseudotime variables in column 214.

FIG. 4 illustrates three specialized Cartesian graphs of the basic linear equations $y_n$ versus $x_n$ as shown in Tables 2A and 2B. According to a first series of experiment using the same fracture-injection/falloff test data set, the three graphs are three straight lines, each having its own slope and intercept.

The first series of experiment consists of 21.3 bbl of 2% KCl water injected at 5.6 bbl/min over a 3.8 min injection period. In this example, the injection fluid is considered as being a slightly compressible fluid. On the contrary, the reservoir contains a compressible fluid that is a dry gas with a gas gravity of 0.63 without significant contaminants at 160° F.

The pressure is measured at the surface or near the test interval. The bottomhole pressure is calculated from the pressure measurements by correcting the pressure for the depth and hydrostatic head. The time interval for each pressure measurement depends on the anticipated time to closure. If the induced fracture is expected to close rapidly, pressure is recorded at least every second during the shut-in period. If the induced fracture required several hours to close, pressure may be recorded every few minutes. The resolution of the pressure gauge is very important. The special plotting functions require calculating pressure differences, so it is important that a gauge correctly measure the difference from one pressure to the next, but the accuracy of each pressure is not critical. For example, consider pressures of 500.00 psi and 500.02 psi. The pressure difference is 0.02 psi, so the gauge needs to have resolution on the order of 0.01 psi. On the other hand, it doesn't matter if the gauge accuracy is poor. For example, if the gauge measures 505.00 and 505.02, then the measurement is within 1% of the actual value. Although there is measurement error in the magnitude of the pressure, the pressure difference is correct. The analysis is affected by resolution (the difference between two measurements), but not necessarily the accuracy.

Reservoir pressure is estimated to be approximately 1,800 psi, and the bottomhole instantaneous shut-in pressure was 2,928 psi with fracture closure stress observed at 2,469 psi. The specialized Cartesian graphs of FIG. 4 use the three forms of plotting functions defined in the three columns of Tables 2A and 2B. The method as used in the prior art which involves the pressure and time variables evaluates the permeability to be 0.0010 md. However, according to the present invention, by using adjusted pseudopressure variable and time, the permeability is estimated to be 0.0018 md. And by using adjusted pseudopressure and adjusted pseudotime variables, the permeability is estimated to be 0.0023 md. FIG. 4 demonstrates that the fracture-injection/falloff test interpretation is influenced by the pressure-dependent properties of the reservoir fluid. Assuming the 0.0023 md permeability estimate is correct, then ignoring the pressure-dependent fluid properties by using a pressure and time formulation results in a 57% permeability estimate error.

Figure 5:
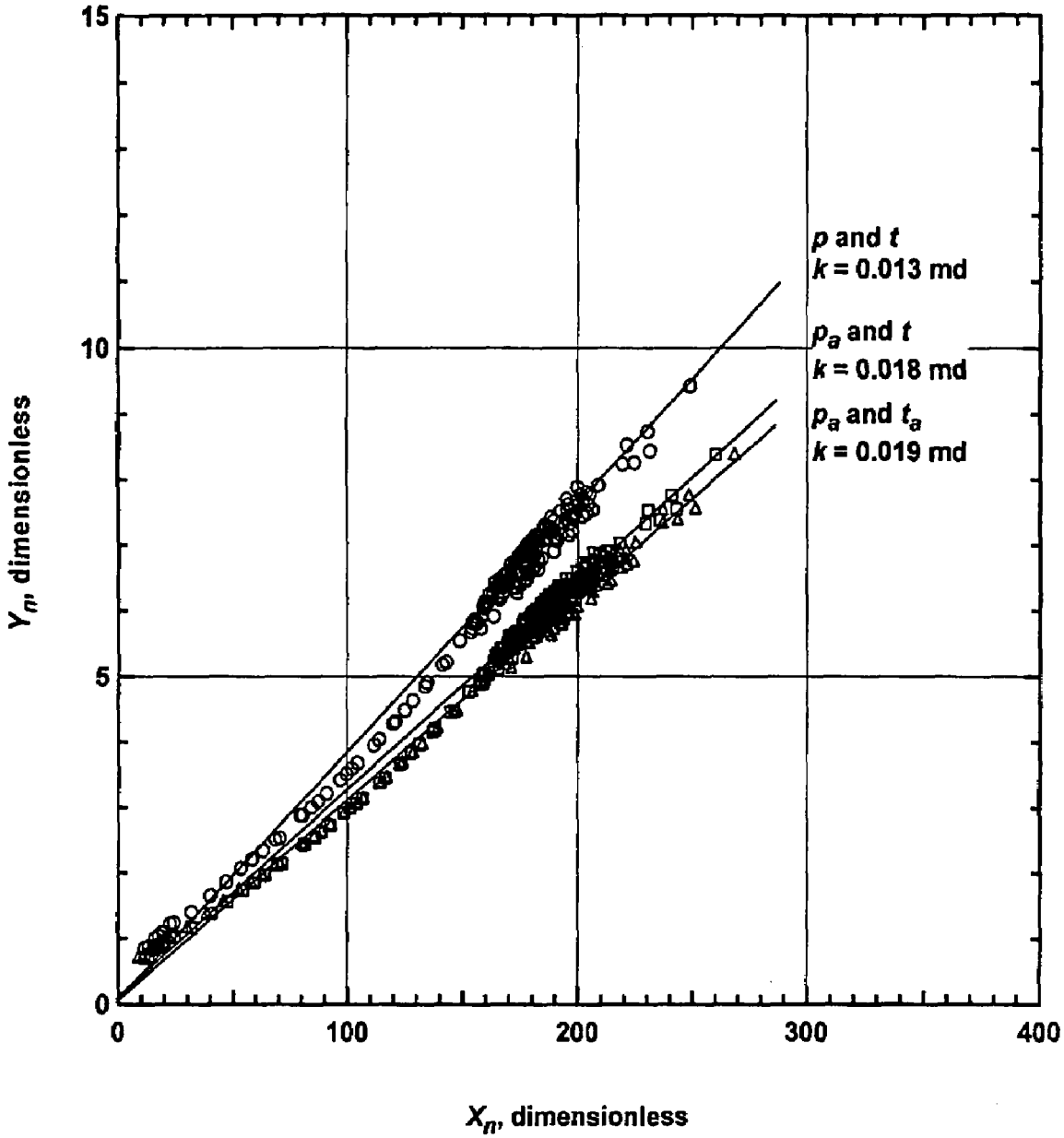
FIG. 5 shows a plotting of three specialized Cartesian graphs of the basic linear equations $y_n$ versus $x_n$ according to a second series of experiments.

According to a second series of experiment, FIG. 5 shows three other specialized Cartesian graphs of the basic linear equations $y_n$ versus $x_n$ as defined in Tables 2A and 2B. These three graphs are also represented by three straight lines with different slopes and intercepts.

The second series of experiment consists of 17.7 bbl of 2% KCl water injected at 3.3 bbl/min over a 5.2 min injection period. The reservoir contains dry gas with a gas gravity of 0.63 without significant contaminants at 160° F. As in the first series of experiment, the injection and reservoir fluids are respectively considered as slightly compressible fluid and compressible fluid. Reservoir pressure is estimated to be approximately 2,380 psi, and the bottomhole instantaneous shut-in pressure was 3,147 psi with fracture closure stress observed at 2,783 psi.

The specialized Cartesian graph of FIG. 5 uses the three forms of plotting functions defined in the three columns of Tables 2A and 2B. The method as used in the prior art which involves the pressure and time variables estimates the permeability to be 0.013 md. However, according to the present invention, by using adjusted pseudopressure data and time as variables, the permeability is estimated to be 0.018 md. By using adjusted pseudopressure and adjusted pseudotime variables, the permeability is estimated to be 0.019 md. Once again, FIG. 5 demonstrates that the fracture-injection/falloff test interpretation is influenced by the pressure-dependent properties of the reservoir fluid. Assuming the 0.019 md permeability estimate is correct, then ignoring the pressure-dependent fluid properties by using a pressure and time formulation results in a 32% permeability estimate error.

Both series of experiments also confirm that as pressure approaches and exceeds 3,000 psi, gas pressure-dependent fluid properties generally will not effect the interpretation significantly. However, adjusted pseudovariables are applicable at all pressures and are recommended for analyzing all fracture-injection/falloff tests with compressible fluids.

Figure 6A:
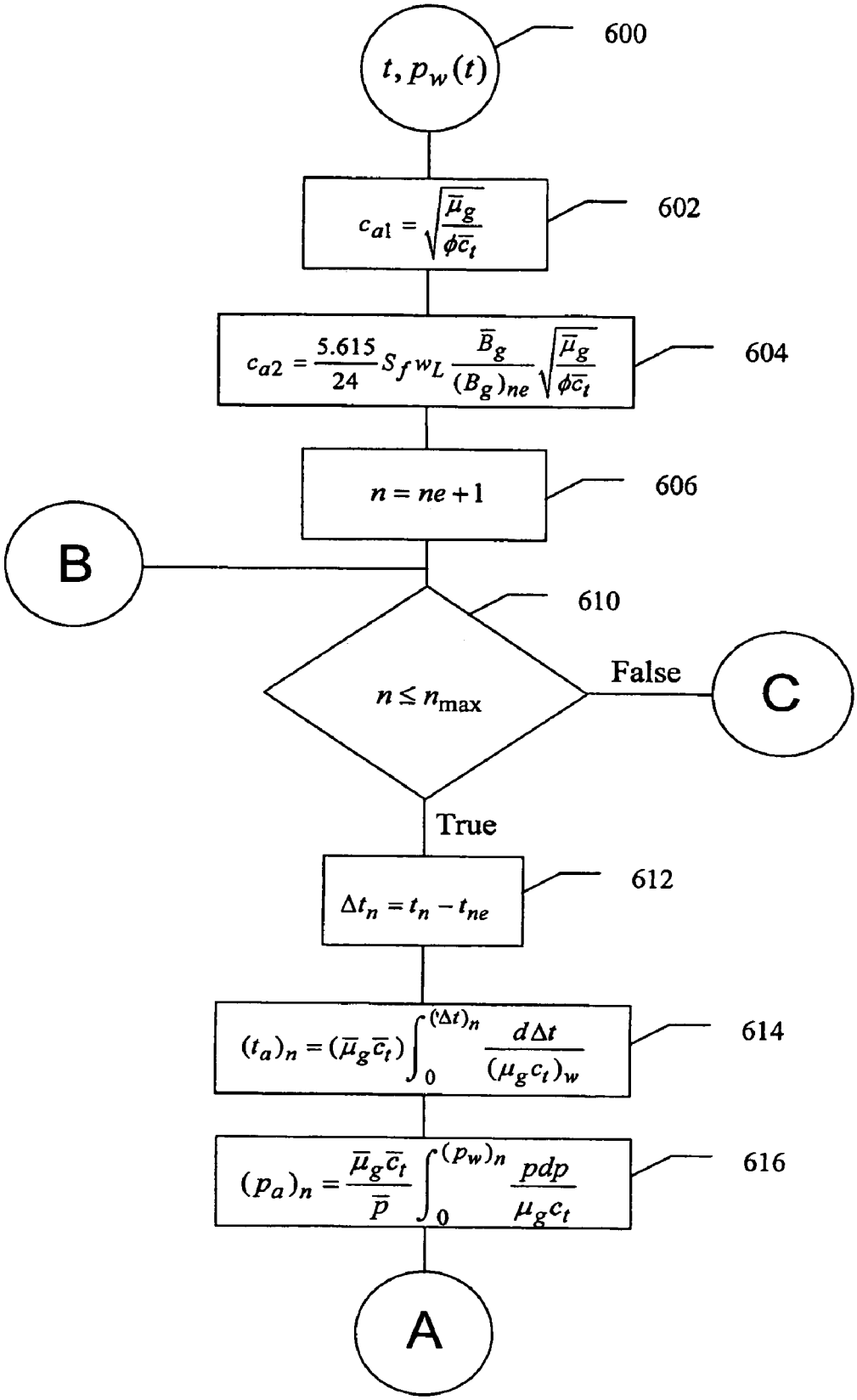
FIGS. 6A, 6B and 6C are a general flow chart representing a method of iterating the measurements and plotting the Cartesian graphs thereof.

FIG. 6 illustrates a general flow chart representing a method of iterating the measurements and plotting the Cartesian graphs thereof. This graph may apply to the case of where the variables are adjusted pseudopressure and adjusted pseudotime.

The time at the end of pumping, $t_{ne}$, becomes the reference time zero, at step 600, and the wellbore pressure is measured at $\Delta t=0$. At steps 602 and 604, calculate the coefficients $$c_{a1} \equiv \sqrt{\frac{\overline{\mu_g}}{\phi \overline{c}_t}} \quad \text{and} \quad c_{a2} \equiv \frac{5.615}{24} S_f w_L \frac{\overline{B}_g}{(B_g)_{ne}} \sqrt{\frac{\overline{\mu_g}}{\phi \overline{c}_t}}$$

At step 606, initialize an internal counter n to ne+1, and test at step 610, if n is still below the $n_{max}$ which corresponds to the data point recorded at fracture closure or the last recorded data point before induced fracture closure. As is previously said, the time interval for each pressure measurement depends on the anticipated time to closure. If the induced fracture is expected to close rapidly, pressure is recorded at least every second during the shut-in period. If the induced fracture required several hours to close, pressure may be recorded every few minutes.

If n is below $n_{max}$, calculate the shut-in time relative to the end of pumping as $\Delta t=t-t_{ne}$ at step 612.

Since the reservoir contains a compressible fluid, its properties will involve the calculation of adjusted pseudovariables. At step 614, the adjusted pseudotime variable is determined by:

$$(t_a)_n = (\mu_g c_t)_0 \int_0^{(\Delta t)_n} \frac{d\Delta t}{(\mu_g c_t)_w}.$$

In an embodiment, $(t_a)_n$ is calculated though it is possible to use time as a variable. At step 616, the adjusted pseudopressure variable is determined by:

$$(p_a)_n = \frac{\overline{\mu}_g \overline{c}_t}{\overline{p}} \int_0^{(p_w)_n} \frac{p\,dp}{\mu_g c_t}.$$

Figure 6B:
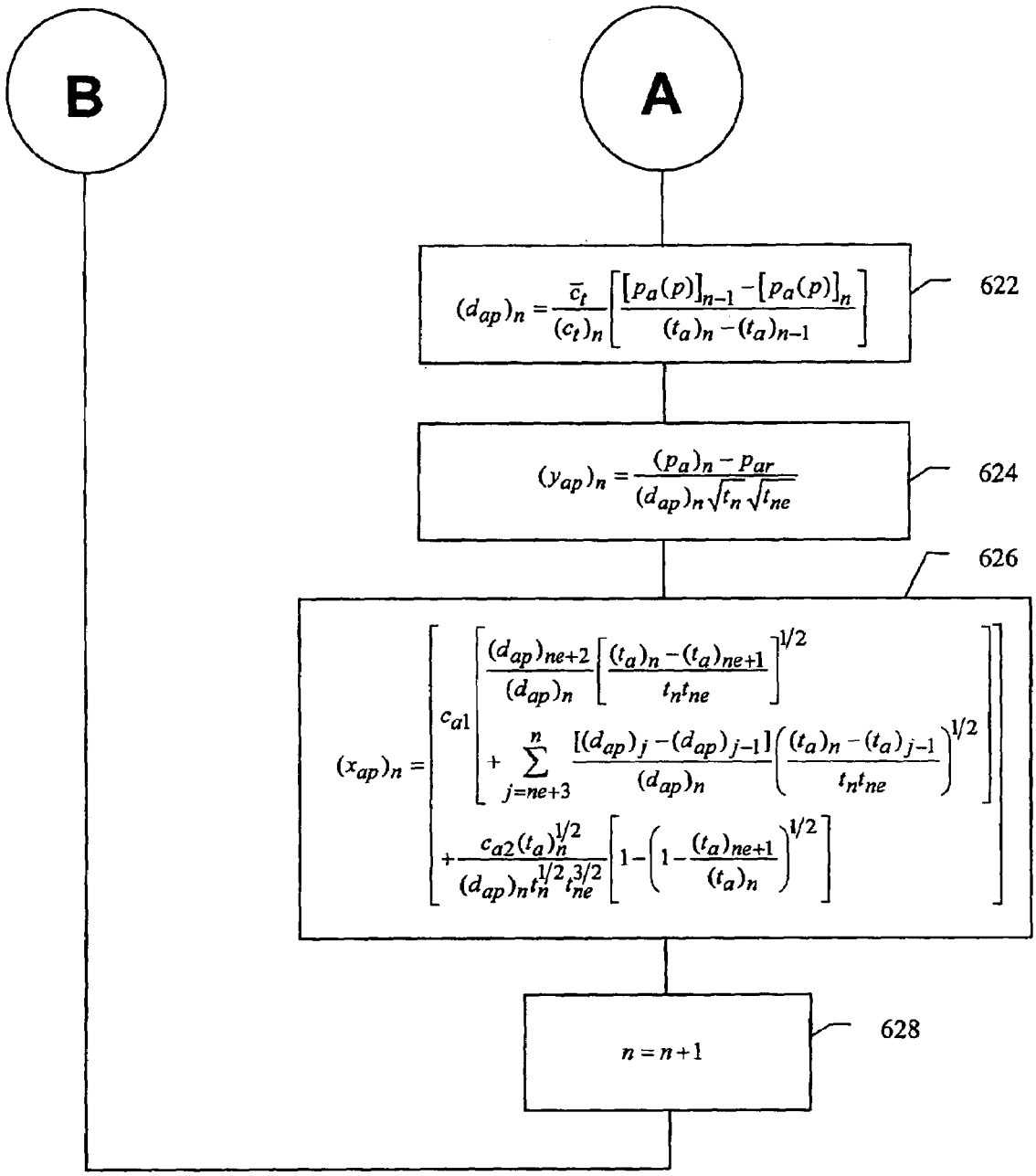

At step 622, in FIG. 6B, based on the compressibility properties of the reservoir fluid, calculate the adjusted pseudopressure variable difference as:

$(\Delta p_a)_n=(p_{aw})_n-p_{ar}$, which can be written as:

$$(d_{ap})_n \equiv \frac{\overline{c}_t}{(c_t)_n}\left[\frac{[p_a(p)]_{n-1}-[p_a(p)]_n}{(t_a)_n-(t_a)_{n-1}}\right].$$

At step 624, calculate the dimensionless before-closure pressure-transient adjusted variable $(y_{ap})_n$ defined as:

$$(y_{ap})_n \equiv \frac{(p_a)_n - p_{ar}}{(d_{ap})_n \sqrt{t_n}\sqrt{t_{ne}}}$$

At step 626, calculate the dimensionless before-closure pressure-transient adjusted variable $(x_{ap})_n$ defined as:

$$(x_{ap})_n \equiv \left[ c_{ap1}\left[ \frac{(d_{ap})_{ne+2}}{(d_{ap})_n}\left[\frac{(t_a)_n-(t_a)_{ne+1}}{t_n t_{ne}}\right]^{1/2} + \sum_{j=ne+3}^{n} \frac{[(d_{ap})_j-(d_{ap})_{j-1}]}{(d_{ap})_n}\left(\frac{(t_a)_n-(t_a)_{j-1}}{t_n t_{ne}}\right)^{1/2} \right] + \frac{c_{ap2}(t_a)_n^{1/2}}{(d_{ap})_n t_n^{1/2} t_{ne}^{3/2}}\left[1-\left(1-\frac{(t_a)_{ne+1}}{(t_a)_n}\right)^{1/2}\right] \right]$$

At step 628, increment the internal counter n by 1 and loop back to step 610 to test if n is still below $n_{max}$.

Figure 6C:
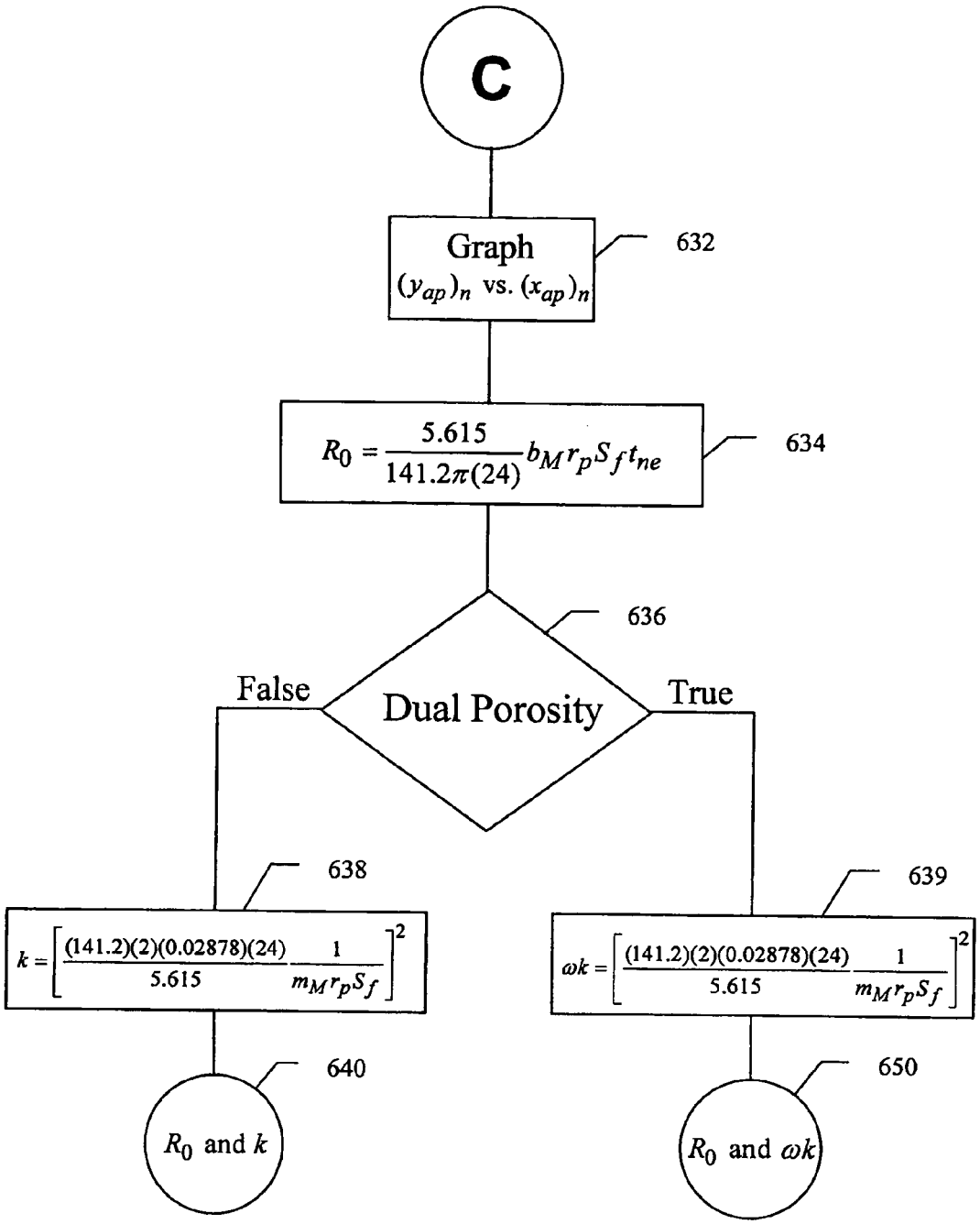

At step 610, if n is above $m_{max}$, FIG. 6C indicates that at step 632, prepare a graph of $(y_{ap})_n$ versus $(x_{ap})_n$.

From the graph obtained, and more specifically from the straight line, derive the value of the intercept $b_M$ which will lead to the evaluation of the reference fracture-face resistance $R_0$ at step 634 using the formula:

$$R_0 = \frac{5.615}{141.2\pi(24)} r_p S_f t_{ne} b_M.$$

However, in order to evaluate the value of the reservoir permeability k, a test at step 636 is done in order to determine if the analysis is performed in a dual-porosity reservoir system. If it is the case of a single porosity, the value of the slope $m_M$ will lead directly to the evaluation of the permeability k, at step 640 by calculating the formula as follows, at step 638:

$$k = \left[\frac{(141.2)(2)(0.02878)(24)}{5.615}\frac{1}{r_p S_f m_M}\right]^2.$$

If it is the case of a dual porosity, the value of a product ωk can be evaluated at step 650 by calculating the formula as follows, at step 639:

$$\omega k = \left[\frac{(141.2)(2)(0.02878)(24)}{5.615}\frac{1}{r_p S_f m_M}\right]^2.$$

Figure 7:
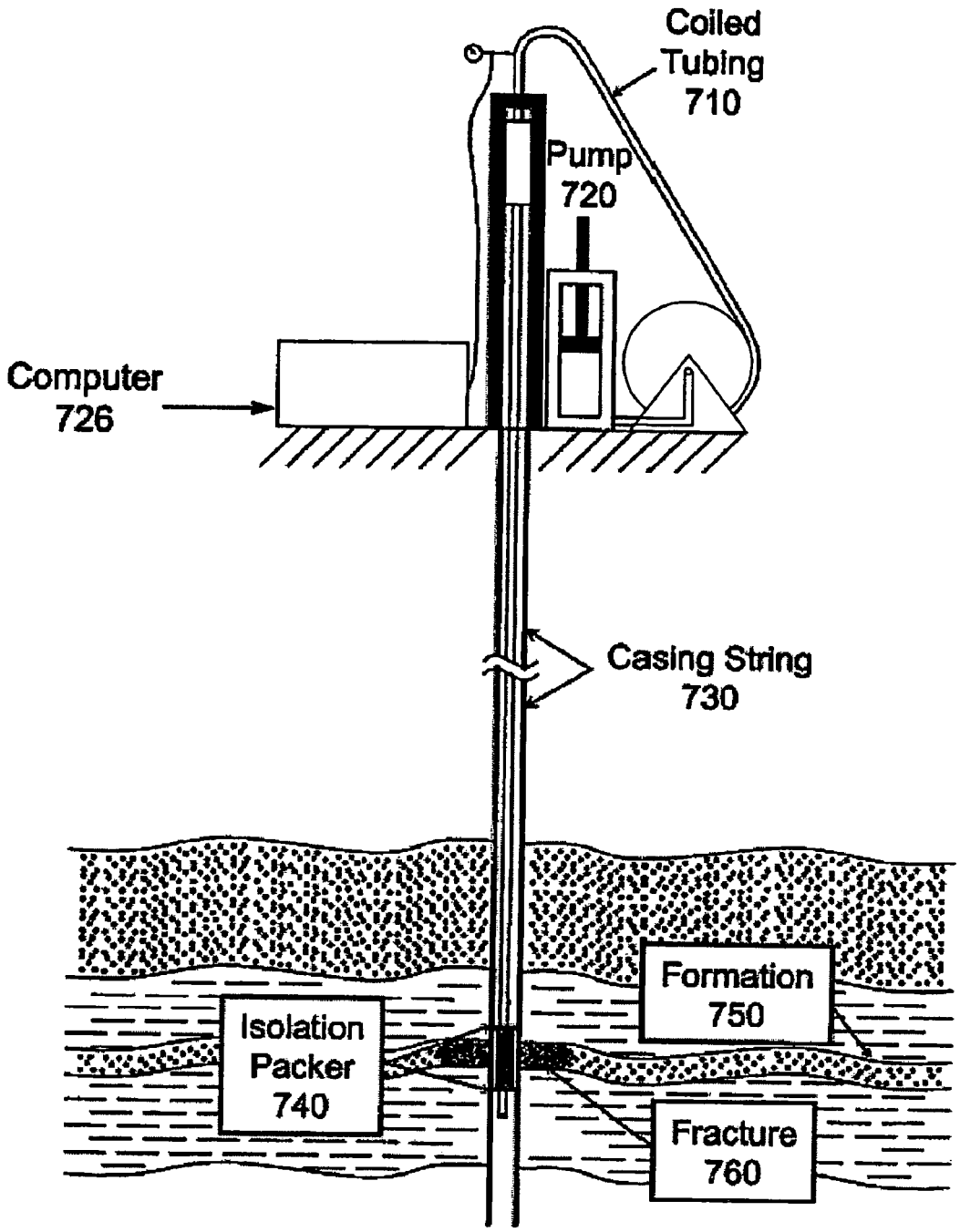
FIG. 7 shows schematically an apparatus located in a wellbore useful in performing the methods of the present invention.

FIG. 7 illustrates schematically an example of an apparatus located in a drilled wellbore to perform the methods of the present invention. Coiled tubing 710 is suspended within a casing string 730 with a plurality of isolation packers 740 arranged spaced apart around the coiled tubing so that the isolation packers can isolate a target formation 750 and provide a seal between the coiled tubing 710 and the casing string 730. These isolation packers can be moved downward or upward in order to test the different layers within the wellbore.

A suitable hydraulic pump 720 is attached to the coiled tubing in order to inject the injection fluid in a reservoir to test for an existing fracture or a new fracture 760. Instrumentation for measuring pressure of the reservoir and injected fluids (not shown) or transducers are provided. The pump which can be a positive displacement pump is used to inject small or large volumes of compressible or slightly compressible fluids containing desirable additives for compatibility with the formation at an injection pressure exceeding the formation fracture pressure.

The data obtained by the measuring instruments are conveniently stored for later manipulation and transformation within a computer 726 located on the surface. Those skilled in the art will appreciate that the data are transmitted to the surface by any conventional telemetry system for storage, manipulation and transformation in the computer 726. The transformed data representative of the before and after closure periods of wellbore storage are then plotted and viewed on a printer or a screen to detect the slope and the intercept of the graph which may be a straight line. The detection of a slope and an intercept enable to evaluate the physical parameters of the reservoir and mainly its permeability and face-fracture resistance.

The invention, therefore, is well adapted to carry out the objects and to attain the ends and advantages mentioned, as well as others inherent therein. While the invention has been depicted, described and is defined by reference to exemplary embodiments of the invention, such references do not imply a limitation on the invention, and no such limitation is to be inferred. The invention is capable of considerable modification, alternation and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

Glossary

| | |
|---|---|
| $A_f$ = | one wing, one face fracture area, $L^2$, $ft^2$ |
| $b_{fs}$ = | fracture-face damage-zone thickness, L, ft |
| $b_M$ = | before-closure specialized plot intercept, dimensionless |
| B = | formation volume factor, dimensionless, bbl/STB |
| $B_g$ = | gas formation volume factor, dimensionless, bbl/Mscf |
| $\overline{B}_g$ = | average gas formation volume factor, dimensionless, bbl/Mscf |
| $c_1$ = | before-closure pressure-transient analysis variable, $m/Lt^{3/2}$, $psi^{1/2} \cdot cp^{1/2}$ |
| $c_2$ = | before-closure pressure-transient analysis variable, $m^2/L^2t^{7/2}$, $psi^{3/2} \cdot cp^{1/2}$ |
| $c_{a1}$ = | before-closure pressure-transient analysis adjusted variable, $m/Lt^{3/2}$, $psi^{1/2} \cdot cp^{1/2}$ |
| $c_{a2}$ = | before-closure pressure-transient analysis adjusted variable, $m^2/L^2t^{7/2}$, $psi^{3/2} \cdot cp^{1/2}$ |
| $c_t$ = | total compressibility, $Lt^2/m$, $psi^{-1}$ |
| $\overline{c}_t$ = | average total compressibility, $Lt^2/m$, $psi^{-1}$ |
| d = | before-closure pressure-transient analysis variable, $m/Lt^3$, psi/hr |
| $d_a$ = | before-closure pressure-transient analysis adjusted variable, $m/Lt^3$, psi/hr |
| E' = | plane-strain modulus, $m/Lt^2$, psi |
| h = | formation thickness, L, ft |
| $h_f$ = | fracture height, L, ft |
| $h_p$ = | fracture permeable thickness, L, ft |
| j = | index, dimensionless |
| k = | permeability, $L^2$, md |
| $k_{fb}$ = | dual-porosity bulk-fracture permeability, $L^2$, md |
| $L_f$ = | hydraulic fracture half length, L, ft |
| $m_M$ = | before-closure specialized plot slope, dimensionless |
| n = | index, dimensionless |
| p = | pressure, $m/Lt^2$, psi |
| $\overline{p}$ = | average pressure, $m/Lt^2$, psi |
| $p_a$ = | adjusted pressure variable, $m/Lt^2$, psi |
| $p_{ar}$ = | adjusted reservoir pressure variable, $m/Lt^2$, psi |
| $p_{aw}$ = | wellbore adjusted pressure variable, $m/Lt^2$, psi |
| $paL_fD$= | dimensionless adjusted pseudopressure variable in a hydraulically fractured well, |
| $p_w$ = | wellbore pressure, $m/Lt^2$, psi |
| $p_{L_fD}$ = | dimensionless pressure in a hydraulically fractured well, dimensionless |
| Δp = | pressure difference, $m/Lt^2$, psi |
| $\Delta p_a$ = | adjusted pressure variable difference, $m/Lt^2$, psi |
| $(\Delta p_a)_{res}$ = | adjusted pressure variable difference across reservoir zone, $m/Lt^2$, psi |
| $(\Delta p_a)_{face}$ = | fracture-face adjusted pressure variable difference, $m/Lt^2$, psi |
| $\Delta p_{cake}$ = | pressure difference across filtercake, $m/Lt^2$, psi |
| $\Delta p_{face}$ = | pressure difference across fracture-face, $m/Lt^2$, psi |
| $\Delta p_{fiz}$ = | pressure difference across filtrate invaded zone, $m/Lt^2$, psi |
| $\Delta p_{piz}$ = | pressure difference across polymer invaded zone, $m/Lt^2$, psi |
| $\Delta p_{res}$ = | pressure difference across reservoir zone, $m/Lt^2$, psi |
| ql = | one wing hydraulic fracture leakoff rate, $L^3/t$, bbl/D |
| $(ql)_g$ = | one wing hydraulic fracture gas leakoff rate, $L^3/t$, bbl/D |
| $qL_f$ = | hydraulically fractured well flow rate, $L^3/t$, STB/D |
| $(qL_f)_g$ = | hydraulically fractured well flow rate, $L^3/t$, STB/D |
| $r_f$ = | hydraulic fracture radius, L, ft |
| $r_p$ = | ratio of permeable to gross fracture area, dimensionless |
| $R_0$ = | reference fracture-face resistance, $m/L^2t$, cp/ft |
| $R'_0$ = | reference fracture-face resistance, $L^{-1}$, $ft^{-1}$ |
| $R_{fs}$ = | fracture-face resistance, $L^{-1}$, ft/md |
| $R_D$ = | dimensionless fracture-face resistance, dimensionless |
| s = | skin, dimensionless |
| $s_f$ = | fracture-face skin, dimensionless |
| $S_f$ = | fracture stiffness, $m/L^2t^2$, psi/ft |
| t = | time, t, hr |
| $t_{aL_f}D$ = | hydraulically fractured well dimensionless adjusted time, dimensionless |
| $t_n$ = | time at timestep n, t, hr |
| $t_{ne}$ = | time at the end of an injection, t, hr |
| $t_{L_f}D$ = | hydraulically fractured well dimensionless time, dimensionless |
| $V_{Lne}$ = | fluid volume lost from one wing of a hydraulic fracture during an injection, $L^3$, $ft^3$ |
| $w_L$ = | fracture lost width, L, ft |
| $x_n$ = | before-closure pressure-transient analysis variable, dimensionless |
| $(x_a)_n$ = | before-closure pressure-transient analysis adjusted variable, dimensionless |

-continued

| | |
|---|---|
| $(y_a)_n$ = | before-closure pressure-transient analysis adjusted variable, dimensionless |
| $y_n$ = | before-closure pressure-transient analysis variable, dimensionless |
| z = | gas deviation factor, dimensionless |
| $\bar{z}$ = | average gas deviation factor, dimensionless |
| Greek | |
| $\mu$ = | viscosity, m/Lt, cp |
| $\bar{\mu}$ = | average viscosity, m/Lt, cp |
| $\mu_g$ = | gas viscosity, m/Lt, cp |
| $\phi$ = | porosity, dimensionless |
| $\omega$ = | natural fracture storativity ratio, dimensionless |

What is claimed is:

1. A method of estimating physical parameters of porous rocks of a subterranean formation containing a compressible reservoir fluid comprising the steps of:

(a) injecting an injection fluid into the subterranean formation at an injection pressure exceeding the subterranean formation fracture pressure;

(b) shutting in the subterranean formation;

(c) gathering pressure measurement data over time from the subterranean formation during shut-in;

(d) transforming the pressure measurement data into corresponding adjusted pseudopressure data to minimize error associated with pressure-dependent reservoir fluid properties; and (e) determining the physical parameters of the subterranean formation from the adjusted pseudopressure data.

2. The method of claim 1 wherein a plot of the adjusted pseudopressure data over time is a straight line with a slope $m_M$ and an intercept $b_M$, wherein $m_M$ is a function of permeability k and $b_M$ is a function of fracture-face resistance $R_0$.

3. The method of claim 2 wherein the adjusted pseudopressure data used in the transforming step are derived using following equation:

$$(p_a)_n = \frac{\bar{\mu}_g \bar{c}_t}{\bar{p}} \int_0^{(p_w)_n} \frac{p\,dp}{\mu_g c_t},$$

wherein $\bar{\mu}$=average viscosity, m/Lt, cp $\mu_g$=gas viscosity, m/Lt, cp p=pressure, m/Lt$_2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{LpD}$=dimensionless pressure in a hydraulically fractured well, dimensionless $c_t$=total compressibility, Lt$^2$/m, psi$^{-1}$ $\bar{c}_t$=average total compressibility, Lt$^2$/m, psi$^{-1}$.

4. The method of claim 3 wherein the straight line is defined by the equation:

$$(y_a)_n = m_M (x_a)_n + b_M, \text{ where}$$

$$(y_a)_n \equiv \frac{(p_a)_n - p_{ar}}{(d_a)_n \sqrt{t_n}\sqrt{t_{ne}}},$$

$$(d_a)_j \equiv \frac{(\mu_g)_j}{\bar{\mu}_g}\left[\frac{[p_a(p)]_{j-1} - [p_a(p)]_j}{t_j - t_{j-1}}\right], \text{ and}$$

-continued $$(x_a)_n \equiv \left[ c_{a1}\left[\frac{(d_a)_{ne+2}}{(d_a)_n}\left(\frac{t_n - t_{ne+1}}{t_n t_{ne}}\right)^{1/2} + \sum_{j=ne+3}^{n} \frac{[(d_a)_j - (d_a)_{j-1}]}{(d_a)_n}\left(\frac{t_n - t_{j-1}}{t_n t_{ne}}\right)^{1/2}\right] + \frac{c_{a2}}{(d_a)_n t_{ne}^{3/2}}\left[1 - \left(1 - \frac{t_{ne+1}}{t_n}\right)^{1/2}\right] \right]$$

wherein $c_{a1}$=a first before-closure pressure-transient analysis adjusted variable, m/Lt$^{3/2}$, psi$^{1/2}$·cp$^{1/2}$ $c_{a2}$=a second before-closure pressure-transient analysis adjusted variable, m$^2$/L$^2$t$^{7/2}$, psi$^{3/2}$·cp$^{1/2}$ $d_a$=before-closure pressure-transient analysis adjusted variable, m/Lt$^3$, psi/hr $\Delta p_a$=adjusted pressure variable difference, m/Lt$^2$, psi $p_{ar}$=adjusted reservoir pressure variable, m/Lt$^2$, psi $p_{aw}$=wellbore adjusted pressure variable, m/Lt$^2$, psi $t_n$=time at timestep n, t, hr $t_{ne}$=time at the end of an injection, t, hr $(x_a)_n$=before-closure pressure-transient analysis adjusted variable, dimensionless $(y_a)_n$=before-closure pressure-transient analysis adjusted variable, dimensionless.

5. The method of claim 4 wherein the first and second before-closure pressure-transient analysis variables are defined as:

$$c_{a1} \equiv \sqrt{\frac{\bar{\mu}_g}{\phi \bar{c}_t}}; \text{ and}$$

$$c_{a2} \equiv \frac{5.615}{24} S_f w_L \frac{\bar{B}_g}{(B_g)_{ne}} \sqrt{\frac{\bar{\mu}_g}{\phi \bar{c}_t}};$$

wherein $\phi$=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

6. The method of claim 5 wherein the transforming step is iterated with a value of n varying from ne+1 to a maximum value $n_{max}$ and for each couple of coordinates $\{(y_a)_n, (x_a)_n\}$ plot the graph $(y_a)_n$ versus $(x_a)_n$ to determine the slope $m_M$ and the intercept $b_M$, wherein ne=number of measurements that corresponds to the end of an injection $n_{max}$=corresponds to the data point recorded at fracture closure or the last recorded data point before induced fracture closure.

7. The method of claim 6 wherein the permeability k and the fracture-face $R_0$ are determined by the following equations:

$$k = \left[\frac{(141.2)(2)(0.02878)(24)}{5.615}\frac{1}{r_p S_f m_M}\right]^2$$

-continued $$R_0 = \frac{5.615}{141.2\pi(24)} r_p S_f t_{ne} b_M.$$

8. The method of claim 6 wherein the permeability k and the fracture-face $R_0$ are determined by the following equations:

$$\omega k = \left[\frac{(141.2)(2)(0.02878)(24)}{5.615}\frac{1}{r_p S_f m_M}\right]^2$$

$$R_0 = \frac{5.615}{141.2\pi(24)} r_p S_f t_{ne} b_M$$

wherein

ω=natural fracture storativity ratio, dimensionless.

9. The method of claim 1 wherein the injection fluid is a liquid, a gas or a combination thereof.

10. The method of claim 9 wherein the injection fluid contains desirable additives for compatibility with the subterranean formation.

11. The method of claim 1 wherein the reservoir fluid is a liquid, a gas or a combination thereof.

12. A method of estimating physical parameters of porous rocks of a subterranean formation containing a compressible reservoir fluid comprising the steps of:

(a) injecting an injection fluid into the subterranean formation at an injection pressure exceeding the subterranean formation fracture pressure;

(b) shutting in the subterranean formation;

(c) gathering pressure measurement data over time from the subterranean formation during shut-in;

(d) transforming the pressure measurement data into corresponding adjusted pseudopressure data and time into adjusted pseudotime data to minimize error associated with pressure-dependent reservoir fluid properties; and (e) determining the physical parameters of the subterranean formation from the adjusted pseudopressure and adjusted pseudotime data.

13. The method of claim 12 wherein a plot of the adjusted pseudopressure data over time is a straight line with a slope $m_M$ and an intercept $b_M$, wherein $m_M$ is a function of permeability k and $b_M$ is a function of fracture-face resistance $R_0$.

14. The method of claim 13 wherein the adjusted pseudotime and adjusted pseudopressure data used in the transforming step are respectively determined by the following equations:

$$(t_a)_n = (\mu_g c_t)_0 \int_0^{(\Delta t)_n} \frac{d\Delta t}{(\mu_g c_t)_w},$$

and $$(p_a)_n = \frac{\bar{\mu}_g \bar{c}_t}{\bar{p}} \int_0^{(p_w)_n} \frac{p\,dp}{\mu_g c_t},$$

wherein $\bar{\mu}$=average viscosity, m/Lt, cp $\mu_g$=gas viscosity, m/Lt, cp p=pressure, m/Lt$^2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{L_fD}$=dimensionless pressure in a hydraulically fractured well, dimensionless $c_t$=total compressibility, Lt$^2$/m, psi$^{-1}$ $\bar{c}_t$=average total compressibility, Lt$^2$/m, psi$^{-1}$.

15. The method of claim 14 wherein the straight line is defined by the equation:

$(y_{ap})_n = b_M + m_M (x_{ap})_n$, where $$(y_{ap})_n \equiv \frac{(p_a)_n - p_{ar}}{(d_{ap})_n \sqrt{t_n}\sqrt{t_{ne}}},$$

$$(d_{ap})_j \equiv \frac{\bar{c}_t}{(c_t)_j}\left[\frac{[p_a(p)]_{j-1} - [p_a(p)]_j}{(t_a)_j - (t_a)_{j-1}}\right], \text{ and}$$

$$(x_{ap}) \equiv \left[\begin{array}{c} c_{ap1}\left[\begin{array}{c} \frac{(d_{ap})_{ne+2}}{(d_{ap})_n}\left[\frac{(t_a)_n - (t_a)_{ne+1}}{t_n t_{ne}}\right]^{1/2} + \\ \sum_{j=ne+3}^{n} \frac{[(d_{ap})_j - (d_{ap})_{j-1}]}{(d_{ap})_n}\left(\frac{(t_a)_n - (t_a)_{j-1}}{t_n t_{ne}}\right)^{1/2} \end{array}\right] + \\ \frac{c_{ap2}(t_a)_n^{1/2}}{(d_{ap})_n t_n^{1/2} t_{ne}^{3/2}}\left[1 - \left(1 - \frac{(t_a)_{ne+1}}{(t_a)_n}\right)^{1/2}\right] \end{array}\right]$$

wherein $c_{ap1}=c_{a1}$=a first before-closure pressure-transient analysis adjusted variable, m/Lt$^{3/2}$, psi$^{1/2}$·cp$^{1/2}$ $c_{ap2}=c_{a2}$=a second before-closure pressure-transient analysis adjusted variable, m$_2$/L$^2$t$^{7/2}$, psi$^{3/2}$·cp$^{1/2}$ $d_{ap}$=before-closure pressure-transient analysis adjusted variable, m/Lt$^3$, psi/hr, with adjusted pseudotime variable $\Delta p_a$=adjusted pressure variable difference, m/Lt$^2$, psi $p_{ar}$=adjusted reservoir variable pressure, m/Lt$^2$, psi $p_{aw}$=wellbore adjusted pressure variable, m/Lt$^2$, psi $t_n$=time at timestep n, t, hr $t_{ne}$=time at the end of an injection, t, hr $(t_a)_n$=adjusted time at timestep n, t, hr $(x_{ap})_n$=before-closure pressure-transient analysis adjusted variable, dimensionless $(y_{ap})_n$=before-closure pressure-transient analysis adjusted variable, dimensionless.

16. The method of claim 15 wherein the first and second before-closure pressure-transient analysis variables are defined as:

$$c_{a1} \equiv \sqrt{\frac{\bar{\mu}_g}{\phi \bar{c}_t}}; \text{ and } c_{a2} \equiv \frac{5.615}{24} S_f w_L \frac{\bar{B}_g}{(B_g)_{ne}}\sqrt{\frac{\bar{\mu}_g}{\phi \bar{c}_t}};$$

wherein

ϕ=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

17. The method of claim 16 wherein the transforming step is iterated with a value of n varying from ne+1 to a maximum value $n_{max}$ and for each couple of coordinates $\{(y_{ap})_n, (x_{ap})_n\}$ plot the graph $(y_{ap})_n$ versus $(x_{ap})_n$ to determine the slope $m_M$ and the intercept $b_M$, wherein ne=number of measurements that corresponds to the end of an injection $n_{max}$=corresponds to the data point recorded at fracture closure or the last recorded data point before induced fracture closure.

18. The method of claim 17 wherein the permeability k and the fracture-face $R_0$ are determined by the following equations:

$$k = \left[\frac{(141.2)(2)(0.02878)(24)}{5.615}\frac{1}{r_p S_f m_M}\right]^2$$

$$R_0 = \frac{5.615}{141.2\pi(24)} r_p S_f t_{ne} b_M.$$

19. The method of claim 17 wherein the permeability k and the fracture-face $R_0$ are determined by the following equations:

$$\omega k = \left[\frac{(141.2)(2)((0.02878)(24)}{5.615}\frac{1}{r_p S_f m_M}\right]^2$$

$$R_0 = \frac{5.615}{141.2\pi(24)} r_p S_f t_{ne} b_M$$

wherein

ω=natural fracture storativity ratio, dimensionless.

20. The method of claim 12 wherein the injection fluid is a liquid, a gas or a combination thereof.

21. The method of claim 20 wherein the injection fluid contains desirable additives for compatibility with the subterranean formation.

22. The method of claim 12 wherein the reservoir fluid is a liquid, a gas or a combination thereof.

23. A method of estimating permeability k of porous rocks of a subterranean formation containing a compressible reservoir fluid comprising the steps of:

(a) injecting an injection fluid into the subterranean formation at an injection pressure exceeding the subterranean formation fracture pressure;

(b) shutting in the subterranean formation;

(c) gathering pressure measurement data over time from the subterranean formation during shut-in;

(d) transforming the pressure measurement data into corresponding adjusted pseudopressure data to minimize error associated with pressure-dependent reservoir fluid properties; and (e) determining the permeability k of the subterranean formation from the adjusted pseudopressure data.

24. The method of claim 23 wherein a plot of the adjusted pseudopressure data over time is a straight line with a slope $m_M$ which is a function of permeability k.

25. The method of claim 24 wherein the adjusted pseudopressure data used in the transforming step are derived using the following equation:

$$(p_a)_n = \frac{\bar{\mu}_g \bar{c}_t}{\bar{p}} \int_0^{(p_w)_n} \frac{p\,dp}{\mu_g c_t},$$

wherein $\bar{\mu}$=average viscosity, m/Lt, cp $\mu_g$=gas viscosity, m/Lt, cp p=pressure, m/Lt$^2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{LfD}$=dimensionless pressure in a hydraulically fractured well, dimensionless $c_t$=total compressibility, Lt$^2$/m, psi$^{-1}$ $\bar{c}_t$=average total compressibility, Lt$^2$/m, psi$^{-1}$.

26. The method of claim 25 wherein the straight line is defined by the equation:

$$(y_a)_n = m_M (x_a)_n + b_M, \text{ where}$$

$$(y_a)_n \equiv \frac{(p_a)_n - p_{ar}}{(d_a)_n \sqrt{t_n}\sqrt{t_{ne}}},$$

$$(d_a)_j \equiv \frac{(\mu_g)_j}{\bar{\mu}_g}\left[\frac{[p_a(p)]_{j-1} - [p_a(p)]_j}{t_j - t_{j-1}}\right], \text{ and}$$

$$(x_a)_n \equiv \left[\begin{array}{c} c_{a1}\left[\begin{array}{c} \frac{(d_a)_{ne+2}}{(d_a)_n}\left[\frac{t_n - t_{ne+1}}{t_n t_{ne}}\right]^{1/2} + \\ \sum_{j=ne+3}^{n} \frac{[(d_a)_j - (d_a)_{j-1}]}{(d_a)_n}\left(\frac{t_n - t_{j-1}}{t_n t_{ne}}\right)^{1/2} \end{array}\right] + \\ \frac{c_{a2}}{(d_a)_n t_{ne}^{3/2}}\left[1 - \left(1 - \frac{t_{ne+1}}{t_n}\right)^{1/2}\right] \end{array}\right]$$

wherein $c_{a1}$=a first before-closure pressure-transient analysis adjusted variable, m/Lt$^{3/2}$, psi$^{1/2}$·cp$^{1/2}$ $c_{a2}$=a second before-closure pressure-transient analysis adjusted variable, m$^2$/L$^2$t$^{7/2}$, psi$^{3/2}$·cp$^{1/2}$ $d_a$=before-closure pressure-transient analysis adjusted variable, m/Lt$^3$, psi/hr $\Delta p_a$=adjusted pressure variable difference, m/Lt$^2$, psi $p_{ar}$=adjusted reservoir pressure variable, m/Lt$^2$, psi $p_{aw}$=wellbore adjusted pressure variable, m/Lt$^2$, psi $t_n$=time at timestep n, t, hr $t_{ne}$=time at the end of an injection, t, hr $(x_a)_n$=before-closure pressure-transient analysis adjusted variable, dimensionless $(y_a)_n$=before-closure pressure-transient analysis adjusted variable, dimensionless.

27. The method of claim 26 wherein the first and second before-closure pressure-transient analysis variables are defined as:

$$c_{a1} \equiv \sqrt{\frac{\bar{\mu}_g}{\phi \bar{c}_t}}; \text{ and } c_{a2} \equiv \frac{5.615}{24} S_f w_L \frac{\bar{B}_g}{(B_g)_{ne}}\sqrt{\frac{\bar{\mu}_g}{\phi \bar{c}_t}};$$

wherein

ϕ=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

28. The method of claim 27 wherein the transforming step is iterated with a value of n varying from ne+1 to a maximum value $n_{max}$ and for each couple of coordinates $\{(y_a)_n, (x_a)_n\}$ plot the graph $(y_a)_n$ versus $(x_a)_n$ to determine the slope $m_M$, wherein ne=number of measurements that corresponds to the end of an injection $n_{max}$=corresponds to the data point recorded at fracture closure or the last recorded data point before induced fracture closure.

29. The method of claim 28 wherein the permeability k is determined by the following equation:

$$k = \left[\frac{(141.2)(2)(0.02878)(24)}{5.615}\frac{1}{r_p S_f m_M}\right]^2.$$

30. The method of claim 28 wherein the permeability k is determined by the following equation:

$$\omega k = \left[\frac{(141.2)(2)(0.02878)(24)}{5.615}\frac{1}{r_p S_f m_M}\right]^2;$$

wherein

ω=natural fracture storativity ratio, dimensionless.

31. The method of claim 23 wherein the injection fluid is a liquid, a gas or a combination thereof.

32. The method of claim 31 wherein the injection fluid contains desirable additives for compatibility with the subterranean formation.

33. The method of claim 23 wherein the reservoir fluid is a liquid, a gas or a combination thereof.

34. A method of estimating permeability k of porous rocks of a subterranean formation containing a compressible reservoir fluid comprising the steps of:

(a) injecting an injection fluid into the subterranean formation at an injection pressure exceeding the subterranean formation fracture pressure;

(b) shutting in the subterranean formation;

(c) gathering pressure measurement data over time from the subterranean formation during shut-in;

(d) transforming the pressure measurement data into corresponding adjusted pseudopressure data and time into adjusted pseudotime data to minimize error associated with pressure-dependent reservoir fluid properties; and (e) determining the permeability k of the subterranean formation from the adjusted pseudopressure and adjusted pseudotime data.

35. The method of claim 34 wherein a plot of the adjusted pseudopressure data over adjusted pseudotime data is a straight line with a slope $m_M$ which is a function of permeability k.

36. The method of claim 35 wherein the adjusted pseudotime and adjusted pseudopressure data used in the transforming step are respectively determined by the following equations:

$$(t_a)_n=(\mu_g c_t)_0\int_0^{(\Delta t)_n} d\Delta t/(\mu_g c_t)_w; \text{ and}$$

$$(p_a)_n=\bar{\mu}_g\bar{c}_t\bar{p}\int_0^{(p_w)_n} p\,dp/\mu_g c_t, \text{ wherein}$$

$\bar{\mu}$=average viscosity, m/Lt, cp $\mu_g$=gas viscosity, m/Lt, cp p=pressure, m/Lt$^2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{LfD}$=dimensionless pressure in a hydraulically fractured well, dimensionless $c_t$=total compressibility, Lt$^2$/m, psi$^{-1}$ $\bar{c}_t$=average total compressibility, Lt$^2$/m, psi$^{-1}$.

37. The method of claim 36 wherein the straight line is defined by the equation:

$$(y_{ap})_n=b_M+m_M(x_{ap})_n, \text{ where}$$

$$(y_{ap})_n \equiv \frac{(p_a)_n - p_{ar}}{(d_{ap})_n\sqrt{t_n}\sqrt{t_{ne}}},$$

$$(d_{ap})_j \equiv \frac{\bar{c}_t}{(c_t)_j}\left[\frac{[p_a(p)]_{j-1}-[p_a(p)]_j}{(t_a)_j-(t_a)_{j-1}}\right], \text{ and}$$

$$(x_{ap})_n \equiv \left[\begin{array}{l} c_{ap1}\left[\frac{(d_{ap})_{ne+2}}{(d_{ap})_n}\left[\frac{(t_a)_n-(t_a)_{ne+1}}{t_n t_{ne}}\right]^{1/2} + \sum_{j=ne+3}^{n}\frac{[(d_{ap})_j-(d_{ap})_{j-1}]}{(d_{ap})_n}\left(\frac{(t_a)_n-(t_a)_{j-1}}{t_n t_{ne}}\right)^{1/2}\right] + \\ \frac{c_{ap2}(t_a)_n^{1/2}}{(d_{ap})_n t_n^{1/2} t_{ne}^{3/2}}\left[1-\left(1-\frac{(t_a)_{ne+1}}{(t_a)_n}\right)^{1/2}\right] \end{array}\right]$$

wherein $c_{ap1}$=$c_{a1}$=a first before-closure pressure-transient analysis adjusted variable, m/Lt$^{3/2}$, psi$^{1/2}$·cp$^{1/2}$ $c_{ap2}$=$c_{a2}$=a second before-closure pressure-transient analysis adjusted variable, m$_2$/L$^2$t$^{7/2}$, psi$^{3/2}$·cp$^{1/2}$ $d_{ap}$=before-closure pressure-transient analysis adjusted variable, m/Lt$^3$, psi/hr, with adjusted pseudotime variable $\Delta p_a$=adjusted pressure variable difference, m/Lt$^2$, psi $p_{ar}$=adjusted reservoir variable pressure, m/Lt$^2$, psi $p_{aw}$=wellbore adjusted pressure variable, m/Lt$^2$, psi $t_n$=time at timestep n, t, hr $t_{ne}$=time at the end of an injection, t, hr $(t_a)_n$=adjusted time at timestep n, t, hr $(x_{ap})_n$=before-closure pressure-transient analysis adjusted variable, dimensionless $(y_{ap})_n$=before-closure pressure-transient analysis adjusted variable, dimensionless.

38. The method of claim 37 wherein the first and second before-closure pressure-transient analysis variables are defined as:

$$c_{a1} \equiv \sqrt{\frac{\bar{\mu}_g}{\phi\bar{c}_t}}; \text{ and}$$

$$c_{a2} \equiv \frac{5.615}{24}S_f w_L\frac{\bar{B}_g}{(B_g)_{ne}}\sqrt{\frac{\bar{\mu}_g}{\phi\bar{c}_t}};$$

wherein

ϕ=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

39. The method of claim 38 wherein the transforming step is iterated with a value of n varying from ne+1 to a maximum value $n_{max}$ and for each couple of coordinates $\{(y_{ap})_n, (x_{ap})_n\}$ plot the graph $(y_{ap})_n$ versus $(x_{ap})_n$ to determine the slope $m_M$, wherein ne=number of measurements that corresponds to the end of an injection $n_{max}$=corresponds to the data point recorded at fracture closure or the last recorded data point before induced fracture closure.

40. The method of claim 39 wherein the permeability k is determined by:

$$k = \left[\frac{(141.2)(2)(0.02878)(24)}{5.615}\frac{1}{r_p S_f m_M}\right]^2.$$

41. The method of claim 39 wherein the permeability k is determined by:

$$\omega k = \left[\frac{(141.2)(2)(0.02878)(24)}{5.615}\frac{1}{r_p S_f m_M}\right]^2$$

wherein

ω=natural fracture storativity ratio, dimensionless.

42. The method of claim 34 wherein the injection fluid is a liquid, a gas or a combination thereof.

43. The method of claim 42 wherein the injection fluid contains desirable additives for compatibility with the subterranean formation.

44. The method of claim 34 wherein the reservoir fluid is a liquid, a gas or a combination thereof.

45. A method of estimating fracture-face resistance $R_0$ of porous rocks of a subterranean formation containing a compressible reservoir fluid comprising the steps of:

(a) injecting an injection fluid into the subterranean formation at an injection pressure exceeding the subterranean formation fracture pressure;

(b) shutting in the subterranean formation;

(c) gathering pressure measurement data over time from the subterranean formation during shut-in;

(d) transforming the pressure measurement data into corresponding adjusted pseudopressure data to minimize error associated with pressure-dependent reservoir fluid properties; and (e) determining the fracture-face resistance $R_0$ of the subterranean formation from the adjusted pseudopressure data.

46. The method of claim 45 wherein a plot of the adjusted pseudopressure data over time is a straight line with an intercept $b_M$ a function of fracture-face resistance $R_0$.

47. The method of claim 46 wherein the adjusted pseudopressure data used in the transforming step are derived using the following equation:

$$(p_a)_n = \frac{\bar{\mu}_g \bar{c}_t}{\bar{p}} \int_0^{(p_w)_n} \frac{p\,dp}{\mu_g c_t},$$

wherein $\bar{\mu}$=average viscosity, m/Lt, cp $\mu_g$=gas viscosity, m/Lt, cp p=pressure, m/Lt$^2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{L_fD}$=dimensionless pressure in a hydraulically fractured well, dimensionless $c_t$=total compressibility, Lt$^2$/m, psi$^{-1}$ $\bar{c}_t$=average total compressibility, Lt$^2$/m, psi$^{-1}$.

48. The method of claim 47 wherein the straight line is defined by the equation:

$$(y_a)_n = m_M (x_a)_n + b_M, \text{ where}$$

$$(y_a)_n \equiv \frac{(p_a)_n - p_{ar}}{(d_a)_n \sqrt{t_n}\sqrt{t_{ne}}},$$

$$(d_a)_j \equiv \frac{(\mu_g)_j}{\bar{\mu}_g}\left[\frac{[p_a(p)]_{j-1} - [p_a(p)]_j}{t_j - t_{j-1}}\right], \text{ and}$$

$$(x_a)_n \equiv \left[c_{a1}\left[\frac{(d_a)_{ne+2}}{(d_a)_n}\left(\frac{t_n - t_{ne+1}}{t_n t_{ne}}\right)^{1/2} + \sum_{j=ne+3}^{n}\frac{[(d_a)_j - (d_a)_{j-1}]}{(d_a)_n}\left(\frac{t_n - t_{j-1}}{t_n t_{ne}}\right)^{1/2}\right] + \frac{c_{a2}}{(d_a)_n t_{ne}^{3/2}}\left[1 - \left(1 - \frac{t_{ne+1}}{t_n}\right)^{1/2}\right]\right]$$

wherein $c_{a1}$=a first before-closure pressure-transient analysis adjusted variable, m/Lt$^{3/2}$, psi$^{1/2}$·cp$^{1/2}$ $c_{a2}$=a second before-closure pressure-transient analysis adjusted variable, m$^2$/L$^2$t$^{7/2}$, psi$^{3/2}$·cp$^{1/2}$ $d_a$=before-closure pressure-transient analysis adjusted variable, m/Lt$^3$, psi/hr $\Delta p_a$=adjusted pressure variable difference, m/Lt$^2$, psi $p_{ar}$=adjusted reservoir pressure variable, m/Lt$^2$, psi $p_{aw}$=wellbore adjusted pressure variable, m/Lt$^2$, psi $t_n$=time at timestep n, t, hr $t_{ne}$=time at the end of an injection, t, hr $(x_a)_n$=before-closure pressure-transient analysis adjusted variable, dimensionless $(y_a)_n$=before-closure pressure-transient analysis adjusted variable, dimensionless.

49. The method of claim 48 wherein the first and second before-closure pressure-transient analysis variables are defined as:

$$c_{a1} \equiv \sqrt{\frac{\bar{\mu}_g}{\phi \bar{c}_t}}\text{; and}$$

$$c_{a2} \equiv \frac{5.615}{24} S_f w_L \frac{\bar{B}_g}{(B_g)_{ne}}\sqrt{\frac{\bar{\mu}_g}{\phi \bar{c}_t}}\text{;}$$

wherein

ϕ=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

50. The method of claim 49 wherein the transforming step is iterated with a value of n varying from ne+1 to a maximum value $n_{max}$ and for each couple of coordinates $\{(y_a)_n, (x_a)_n\}$ plot the graph $(y_a)_n$ versus $(x_a)_n$ to determine the slope $b_M$, wherein ne=number of measurements that corresponds to the end of an injection $n_{max}$=corresponds to the data point recorded at fracture closure or the last recorded data point before induced fracture closure.

51. The method of claim 50 wherein the fracture-face $R_0$ is determined by:

$$R_0 = \frac{5.615}{141.2\pi(24)} r_p S_f t_{ne} b_M .$$

52. The method of claim 45 wherein the injection fluid is a liquid, a gas or a combination thereof.

53. The method of claim 52 wherein the injection fluid contains desirable additives for compatibility with the subterranean formation.

54. The method of claim 45 wherein the reservoir fluid is a liquid, a gas or a combination thereof.

55. A method of estimating fracture-face resistance $R_0$ of porous rocks of a subterranean formation containing a compressible reservoir fluid comprising the steps of:

(a) injecting an injection fluid into the subterranean formation at an injection pressure exceeding the subterranean formation fracture pressure;

(b) shutting in a zone of the subterranean formation;

(c) gathering pressure measurement data over time from the subterranean formation during shut-in;

(d) transforming the pressure measurement data into corresponding adjusted pseudopressure data and time into adjusted pseudotime data to minimize error associated with pressure-dependent reservoir fluid properties; and (e) determining the fracture-face resistance $R_0$ of the subterranean formation from the adjusted pseudopressure and adjusted pseudotime data.

56. The method of claim 55 wherein a plot of the adjusted pseudopressure data over adjusted pseudotime data is a straight line with an intercept $b_M$ a function of fracture-face resistance $R_0$.

57. The method of claim 56 wherein the adjusted pseudotime and adjusted pseudopressure data used in the transforming step are respectively determined by:

$$(t_a)_n = (\mu_g c_t)_0 \int_0^{(\Delta t)_n} \frac{d\Delta t}{(\mu_g c_t)_w};$$

and $$(p_a)_n = \frac{\bar{\mu}_g \bar{c}_t}{\bar{p}} \int_0^{(p_w)_n} \frac{p\,dp}{\mu_g c_t},$$

wherein $\bar{\mu}$=average viscosity, m/Lt, cp $\mu_g$=gas viscosity, m/Lt, cp p=pressure, m/Lt$^2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{L_fD}$=dimensionless pressure in a hydraulically fractured well, dimensionless $c_t$=total compressibility, Lt$^2$/m, psi$^{-1}$ $\bar{c}_t$=average total compressibility, Lt$^2$/m, psi$^{-1}$.

58. The method of claim 57 wherein the straight line is defined by the equation:

$(y_{ap})_n = b_M + m_M (x_{ap})_n$, where $$(y_{ap})_n \equiv \frac{(p_a)_n - p_{ar}}{(d_{ap})_n \sqrt{t_n}\sqrt{t_{ne}}},$$

$$(d_{ap})_j \equiv \frac{\bar{c}_t}{(c_t)_j}\left[\frac{[p_a(p)]_{j-1} - [p_a(p)]_j}{(t_a)_j - (t_a)_{j-1}}\right], \text{ and}$$

$$(x_{ap})_n \equiv \left[ c_{ap1}\left[\frac{(d_{ap})_{ne+2}}{(d_{ap})_n}\left[\frac{(t_a)_n - (t_a)_{ne+1}}{t_n t_{ne}}\right]^{1/2} + \sum_{j=ne+3}^{n} \frac{[(d_{ap})_j - (d_{ap})_{j-1}]}{(d_{ap})_n}\left(\frac{(t_a)_n - (t_a)_{j-1}}{t_n t_{ne}}\right)^{1/2}\right] + \frac{c_{ap2}(t_a)_n^{1/2}}{(d_{ap})_n t_n^{1/2} t_{ne}^{3/2}}\left[1 - \left(1 - \frac{(t_a)_{ne+1}}{(t_a)_n}\right)^{1/2}\right]\right]$$

wherein $c_{ap1}=c_{a1}$=a first before-closure pressure-transient analysis adjusted variable, m/Lt$^{3/2}$, psi$^{1/2}$·cp$^{1/2}$ $c_{ap2}=c_{a2}$=a second before-closure pressure-transient analysis adjusted variable, m$_2$/L$^2$t$^{7/2}$, psi$^{3/2}$·cp$^{1/2}$ $d_{ap}$=before-closure pressure-transient analysis adjusted variable, m/Lt$^3$, psi/hr, with adjusted pseudotime variable $\Delta p_a$=adjusted pressure variable difference, m/Lt$^2$, psi $p_{ar}$=adjusted reservoir variable pressure, m/Lt$^2$, psi $p_{aw}$=wellbore adjusted pressure variable, m/Lt$^2$, psi $t_n$=time at timestep n, t, hr $t_{ne}$=time at the end of an injection, t, hr $(t_a)_n$=adjusted time at timestep n, t, hr $(x_{ap})_n$=before-closure pressure-transient analysis adjusted variable, dimensionless $(y_{ap})_n$=before-closure pressure-transient analysis adjusted variable, dimensionless.

59. The method of claim 58 wherein the first and second before-closure pressure-transient analysis variables are defined as:

$$c_{a1} \equiv \sqrt{\frac{\bar{\mu}_g}{\phi \bar{c}_t}}; \text{ and } c_{a2} \equiv \frac{5.615}{24} S_f w_L \frac{\bar{B}_g}{(B_g)_{ne}} \sqrt{\frac{\bar{\mu}_g}{\phi \bar{c}_t}};$$

wherein $\phi$=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

60. The method of claim 59 wherein the transforming step is iterated with a value of n varying from ne+1 to a maximum value $n_{max}$ and for each couple of coordinates $\{(y_{ap})_n, (x_{ap})_n\}$ plot the graph $(y_{ap})_n$ versus $(x_{ap})_n$ to determine the intercept $b_M$, wherein ne=number of measurements that corresponds to the end of an injection $n_{max}$=corresponds to the data point recorded at fracture closure or the last recorded data point before induced fracture closure.

61. The method of claim 60 wherein the fracture-face $R_0$ is determined by:

$$R_0 = \frac{5.615}{141.2\pi(24)} r_p S_f t_{ne} b_M .$$

62. The method of claim 55 wherein the injection fluid is a liquid, a gas or a combination thereof.

63. The method of claim 62 wherein the injection fluid contains desirable additives for compatibility with the subterranean formation.

64. The method of claim 55 wherein the reservoir fluid is a liquid, a gas or a combination thereof.

65. A system for estimating physical parameters of porous rocks of a subterranean formation containing a compressible reservoir fluid comprising:

(a) a pump for injecting an injection fluid into the subterranean formation at an injection pressure exceeding the subterranean formation fracture pressure;

(b) means for gathering pressure measurement data from the subterranean formation during a shut-in period;

(c) means for transforming the pressure measurement data into adjusted pseudopressure data to minimize error associated with pressure-dependent reservoir fluid properties; and (d) means for determining the physical parameters of the subterranean formation from the adjusted pseudopressure data.

66. The system of claim 65 wherein the determining means comprises graphics means for plotting a graph of the adjusted pseudopressure data over time, the graph being a straight line with a slope $m_M$ and an intercept $b_M$ wherein $m_M$ is a function of permeability k and $b_M$ is a function of fracture-face resistance $R_0$.

67. The system of claim 66 wherein the adjusted pseudopressure data is defined by the following equation:

$$(p_a)_n = \frac{\bar{\mu}_g \bar{c}_t}{\bar{p}} \int_0^{(p_w)_n} \frac{p\,dp}{\mu_g c_t},$$

wherein $\bar{\mu}$=average viscosity, m/Lt, cp $\mu_g$=gas viscosity, m/Lt, cp p=pressure, m/Lt$^2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{LfD}$=dimensionless pressure in a hydraulically fractured well, dimensionless $c_t$=total compressibility, Lt$^2$/m, psi$^{-1}$ $\bar{c}_t$=average total compressibility, Lt$^2$/m, psi$^{-1}$.

68. The method of claim 67 wherein the straight line is defined by the equation:

$(y_a)_n = m_M (x_a)_n + b_M$, where $$(y_a)_n \equiv \frac{(p_a)_n - p_{ar}}{(d_a)_n \sqrt{t_n}\sqrt{t_{ne}}},$$

$$(d_a)_j \equiv \frac{(\mu_g)_j}{\bar{\mu}_g}\left[\frac{[p_a(p)]_{j-1} - [p_a(p)]_j}{t_j - t_{j-1}}\right], \text{ and}$$

-continued $$(x_a)_n \equiv \left[ c_{a1}\left[\frac{(d_a)_{ne+2}}{(d_a)_n}\left[\frac{t_n - t_{ne+1}}{t_n t_{ne}}\right]^{1/2} + \sum_{j=ne+3}^{n} \frac{[(d_a)_j - (d_a)_{j-1}]}{(d_a)_n}\left(\frac{t_n - t_{j-1}}{t_n t_{ne}}\right)^{1/2}\right] + \frac{c_{a2}}{(d_a)_n t_{ne}^{3/2}}\left[1 - \left(1 - \frac{t_{ne+1}}{t_n}\right)^{1/2}\right] \right]$$

wherein $c_{a1}$=a first before-closure pressure-transient analysis adjusted variable, m/Lt$^{3/2}$, psi$^{1/2}$·cp$^{1/2}$ $c_{a2}$=a second before-closure pressure-transient analysis adjusted variable, m$^2$/L$^2$t$^{7/2}$, psi$^{3/2}$·cp$^{1/2}$ $d_a$=before-closure pressure-transient analysis adjusted variable, m/Lt$^3$, psi/hr $\Delta p_a$=adjusted pressure variable difference, m/Lt$^2$, psi $p_{ar}$=adjusted reservoir pressure variable, m/Lt$^2$, psi $p_{aw}$=wellbore adjusted pressure variable, m/Lt$^2$, psi $t_n$=time at timestep n, t, hr $t_{ne}$=time at the end of an injection, t, hr $(x_a)_n$=before-closure pressure-transient analysis adjusted variable, dimensionless $(y_a)_n$=before-closure pressure-transient analysis adjusted variable, dimensionless.

69. The method of claim 68 wherein the first and second before-closure pressure-transient analysis variables are defined as:

$$c_{a1} \equiv \sqrt{\frac{\bar{\mu}_g}{\phi \bar{c}_t}}\ ; \text{ and } c_{a2} \equiv \frac{5.615}{24} S_f w_L \frac{\bar{B}_g}{(B_g)_{ne}} \sqrt{\frac{\bar{\mu}_g}{\phi \bar{c}_t}}\ ;$$

wherein $\phi$=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

70. The system of claim 69 wherein the transforming means iterates the transformation of each adjusted pseudo-data with a value of n varying from ne+1 to a maximum value $n_{max}$, and wherein the graphics means plots the graph $(y_a)_n$ versus $(x_a)_n$ to determine the slope $m_M$ and the intercept $b_M$, wherein ne=number of measurements that corresponds to the end of an injection $n_{max}$=corresponds to the data point recorded at fracture closure or the last recorded data point before induced fracture closure.

71. The system of claim 70 wherein the permeability k and the fracture-face $R_0$ are determined by the following equations:

$$k = \left[\frac{(141.2)(2)(0.02878)(24)}{5.615}\frac{1}{r_p S_f m_M}\right]^2 ; \text{ and}$$

$$R_0 = \frac{5.615}{141.2\pi(24)} r_p S_f t_{ne} b_M .$$

72. The system of claim 70 wherein the permeability k and the fracture-face $R_0$ are determined by the following equations:

$$\omega k = \left[\frac{(141.2)(2)(0.02878)(24)}{5.615}\frac{1}{r_p S_f m_M}\right]^2; \text{ and}$$

$$R_0 = \frac{5.615}{141.2\pi(24)} r_p S_f t_{ne} b_M;$$

wherein $\omega$=natural fracture storativity ratio, dimensionless.

73. The system of claim 65 wherein the injection fluid a liquid, a gas or a combination thereof.

74. The system of claim 73 wherein the injection fluid contains desirable additives for compatibility with the subterranean formation.

75. The system of claim 65 wherein the reservoir fluid is a liquid, a gas or a combination thereof.

76. A system of estimating physical parameters of porous rocks of a subterranean formation containing a compressible reservoir fluid comprising:

(a) a pump for injecting an injection fluid into the subterranean formation at an injection pressure exceeding the subterranean formation fracture pressure;

(b) means for gathering pressure measurement data from the subterranean formation during a shut-in period;

(c) means for transforming the pressure measurement data into adjusted pseudopressure data and time into adjusted pseudotime data to minimize error associated with pressure-dependent reservoir fluid properties; and (d) means for detecting characteristics of the evolution in the adjusted pseudopressure data over adjusted pseudotime data to determine the physical parameters of the subterranean formation.

77. The system of claim 76 wherein the detecting means comprises graphics means for plotting the evolution of the adjusted pseudopressure data over adjusted pseudotime data, the evolution being a straight line with a slope $m_M$ a function of permeability k and an intercept $b_M$ a function of fracture-face resistance $R_0$.

78. The system of claim 77 wherein adjusted pseudotime and adjusted pseudopressure data are respectively determined by the equations:

$$(t_a)_n = (\mu_g c_t)_0 \int_0^{(\Delta t)_n} \frac{d\Delta t}{(\mu_g c_t)_w};$$

and $$(p_a)_n = \frac{\bar{\mu}_g \bar{c}_t}{\bar{p}} \int_0^{(p_w)_n} \frac{p\,dp}{\mu_g c_t},$$

wherein $\bar{\mu}$=average viscosity, m/Lt, cp $\mu_g$=gas viscosity, m/Lt, cp p=pressure, m/Lt$^2$, psi $\bar{p}$=average pressure, m/Lt$^2$, psi $p_a$=adjusted pseudopressure variable, m/Lt$^2$, psi $p_w$=wellbore pressure, m/Lt$^2$, psi $p_{LfD}$=dimensionless pressure in a hydraulically fractured well, dimensionless $c_t$=total compressibility, Lt$^2$/m, psi $\bar{c}_t$=average total compressibility, Lt$^2$/m, psi$^{-1}$.

79. The system of claim 78 wherein the straight line is defined by the equation:

$(y_{ap})_n = b_M + m_M (x_{ap})_n$, where $$(y_{ap})_n \equiv \frac{(p_a)_n - p_{ar}}{(d_{ap})_n \sqrt{t_n} - \sqrt{t_{ne}}},$$

$$(d_{ap})_j \equiv \frac{\bar{c}_t}{(c_t)_j}\left[\frac{[p_a(p)]_{j-1} - [p_a(p)]_j}{(t_a)_j - (t_a)_{j-1}}\right], \text{ and}$$

$$(x_{ap})_n \equiv \left[\begin{array}{l} c_{ap1}\left[\frac{(d_{ap})_{ne+2}}{(d_{ap})_n}\left[\frac{(t_a)_n - (t_a)_{ne+1}}{t_n t_{ne}}\right]^{1/2} + \sum_{j=ne+3}^{n} \frac{[(d_{ap})_j - (d_{ap})_{j-1}]}{(d_{ap})_n}\left(\frac{(t_a)_n - (t_a)_{j-1}}{t_n t_{ne}}\right)^{1/2}\right] + \\ \frac{c_{ap2}(t_a)_n^{1/2}}{(d_{ap})_n t_n^{1/2} t_{ne}^{3/2}}\left[1 - \left(1 - \frac{(t_a)_{ne+1}}{(t_a)_n}\right)^{1/2}\right] \end{array}\right]$$

wherein $c_{ap1}$=$c_{a1}$=a first before-closure pressure-transient analysis adjusted variable, m/Lt$^{3/2}$, psi$^{1/2}$·cp$^{1/2}$ $c_{ap2}$=$c_{a2}$=a second before-closure pressure-transient analysis adjusted variable, m$^2$/L$^2$t$^{7/2}$, psi$^{3/2}$·cp$^{1/2}$ $d_{ap}$=before-closure pressure-transient analysis adjusted variable, m/Lt$^3$, psi/hr, with adjusted pseudotime variable $\Delta p_a$=adjusted pressure variable difference, m/Lt$^2$, psi $p_{ar}$=adjusted reservoir pressure variable, m/Lt$^2$, psi $p_{aw}$=wellbore adjusted pressure variable, m/Lt$^2$, psi $t_n$=time at timestep n, t, hr $t_{ne}$=time at the end of an injection, t, hr $(t_a)_n$=adjusted time at timestep n, t, hr $(x_{ap})_n$=before-closure pressure-transient analysis adjusted variable, dimensionless $(y_{ap})_n$=before-closure pressure-transient analysis adjusted variable, dimensionless.

80. The system of claim 79 wherein the first and second before-closure pressure-transient analysis variables are defined as:

$$c_{a1} \equiv \sqrt{\frac{\bar{\mu}_g}{\phi \bar{c}_t}}; \text{ and}$$

$$c_{a2} \equiv \frac{5.615}{24} S_f w_L \frac{\bar{B}_g}{(B_g)_{ne}} \sqrt{\frac{\bar{\mu}_g}{\phi \bar{c}_t}};$$

wherein $\phi$=porosity, dimensionless $B_g$=gas formation volume factor, dimensionless, bbl/Mscf $\bar{B}_g$=average gas formation volume factor, dimensionless, bbl/Mscf $S_f$=fracture stiffness, m/L$^2$t$^2$, psi/ft $w_L$=fracture lost width, L, ft.

81. The system of claim 80 wherein the transforming means iterates the transformation of each adjusted pseudo-data with a value of n varying from ne+1 to a maximum value $n_{max}$, and wherein the graphics means plots the graph $(y_a)_n$ versus $(x_a)_n$ to determine the slope $m_M$ and the intercept $b_M$, wherein ne=number of measurements that corresponds to the end of an injection $n_{max}$=corresponds to the data point recorded at fracture closure or the last recorded data point before induced fracture closure.

82. The system of claim 80 wherein the permeability k and the fracture-face $R_0$ are determined by the equations:

$$k = \left[\frac{(141.2)(2)(0.02878)(24)}{5.615}\frac{1}{r_p S_f m_M}\right]^2; \text{ and}$$

$$R_0 = \frac{5.615}{141.2\pi(24)} r_p S_f t_{ne} b_M.$$

83. The system of claim 80 wherein the permeability k and the fracture-face $R_0$ are determined by the equations:

$$\omega k = \left[\frac{(141.2)(2)(0.02878)(24)}{5.615}\frac{1}{r_p S_f m_M}\right]^2;$$

$$R_0 = \frac{5.615}{141.2\pi(24)} r_p S_f t_{ne} b_M;$$

wherein

ω=natural fracture storativity ratio, dimensionless.

84. The system of claim 76 wherein the injection fluid is of a liquid, a gas or a combination thereof.

85. The system of claim 84 wherein the injection fluid contains desirable additives for compatibility with the subterranean formation.

86. The system of claim 76 wherein the reservoir fluid is a liquid, a gas or a combination thereof.

* * * * *